United States Patent [19]

Grenier

[11] 4,181,174

[45] Jan. 1, 1980

[54] HEAT EXCHANGERS

[75] Inventor: Maurice Grenier, Paris, France

[73] Assignee: L'air Liquide, Societe Anonyme pour l'etude et l'Exploitation des Procedes Georges Claude, Paris, France

[21] Appl. No.: 885,112

[22] Filed: Mar. 10, 1978

[30] Foreign Application Priority Data

Mar. 16, 1977 [FR] France ..... 77 07777

[51] Int. Cl.[2] ..... F28F 21/00

[52] U.S. Cl. ..... 165/180

[58] Field of Search ..... 165/180, 172, 164

[56] References Cited

U.S. PATENT DOCUMENTS

| | | | |
|---|---|---|---|
| 2,621,027 | 12/1952 | Tatsch | 165/180 |
| 2,821,369 | 1/1958 | Hilliard | 165/180 |
| 2,887,303 | 5/1959 | Reys | 165/180 |
| 3,106,957 | 10/1963 | Cannon | 165/180 |
| 3,182,720 | 5/1965 | Brown | 165/180 |
| 3,925,021 | 12/1975 | Yoshino et al. | 165/180 |

*Primary Examiner*—Lloyd L. King

*Attorney, Agent, or Firm*—Young & Thompson

[57] ABSTRACT

This invention relates chiefly to a thermal exchange assembly intended for cooling a gas.

A thermal exchange assembly according to the invention includes at least four passages intended respectively for cooling a refrigerant mixture, cooling a gas being processed, heating the refrigerant mixture, and heating an auxiliary refrigerant.

The invention is applicable in particular to the liquefaction of gases and gaseous mixtures.

18 Claims, 19 Drawing Figures

HEAT EXCHANGERS

BACKGROUND OF THE INVENTION

The present invention relates firstly to a thermal exchange assembly, comprising one or more members of the plate heat-exchanger type which are intended for cooling a gas, secondly to an installation for cooling a gas which employs a thermal exchange assembly according to the invention, and thirdly, and subsidiarily, to a method of cooling a gas which is adapted to make use of a thermal exchange assembly according to the invention.

Because of their large area of exchange surface per unit of volume, plate exchangers, or to be more exact compact plate exchangers made of brazed metal, appear particularly well suited to cooling a gas (whether the gas involved is pure or a mixture of gases), by indirect heat exchange with one or more successive refrigerants (whether the refrigerants have only one constituent or more than one).

However, when one or more multi-constituent refrigerants are used to cool a gas, there is a major, even irremediable, disadvantage in using plate exchangers which results from the need for this refrigerant or these refrigerants to travel in a di-phase form (liquid plus vapour) at some time or other in the cooling cycle. Once this is the case, it is necessary that the liquid and vapour phases of the multi-constituent refrigerant should be uniformly distributed:

possibly between the various heat exchange members, when the latter are arranged in parallel to cool the gas being dealt with. In this regard, given the relatively limited size of plate heat-exchanging members currently available on the market, it is always necessary to use a plurality of members in parallel to cool a gas in large quantities, between the various passages in the same heat exchange member which are reserved for the flow of the multi-constituent refrigerant, and within one and the same passage in a heat-exchange member which is reserved for the flow of the said refrigerant, in order to achieve substantially uniform equilibrium temperatures between the liquid and vapour of the multiple refrigerant and thus heat exchange between the said refrigerant and the gas being dealt with which is uniform overall.

The thermodynamic reversibility of the cooling method employed, whatever are the physical operations which are performed successively and cyclically on the multiple refrigerant, and thus the attainment of a satisfactory energy efficiency for the method selected, are achieved at the expense of having the multiple refrigerant in di-phase form in the course of cooling, and/or while it is heating up, and/or before it is heated up.

To distribute a di-phase fluid (liquid plus gas) uniformly between the various passage in one and the same plate exchanger, various arrangements have already been proposed but none of these has proved satisfactory, either because they result in unacceptable technical complexity or because the uniformity achieved in the di-phase distribution is still unsatisfactory.

Starting from this realisation, in accordance with the present invention and in contrast to solutions proposed in the prior art, an attempt has been made to solve the problem described above by restricting the need for and the extent of di-phase distribution in a plate exchanger to the minimum, not only as regards the multi-constituent refrigerants used but also as regards the gas to be cooled, and this has been done by using particular arrangements in the exchanger or exchangers employed, and/or by selecting particular conditions of operation in the cooling cycle or cycles selected.

SUMMARY OF THE INVENTION

A thermal exchange assembly according to the invention includes one or more thermal exchange members of the plate heat-exchanger kind, comprising:

a plurality of metal plates of substantially similar outline which extend in a first dimension, or length, and a second dimension, or width, and which are spaced from one another and ranged parallel to one another in a third dimension, or thickness, sealing means which, in conjunction with the aforementioned plates, define a plurality of flattened passages, at least one passage of a first type which belongs to a first circuit intended for the flow, throughout the length of the member in question, of a first fluid (in particular a refrigerant mixture to be cooled), the sealing means allotted to each passage of the first type leaving open at the two ends of the latter an inlet and an outlet respectively for the refrigerant mixture, and/or at least one passage of a second type which belongs to a second circuit intended for the flow, over at least a part of the length of the said member, of a second fluid (in particular a gas to be cooled) in co-current with the said first fluid, the sealing means allotted to each passage of the second type leaving open at the two ends of the latter an inlet and an outlet respectively for the said gas, at least one passage of a third type in thermal exchange relation with at least one of the two passages of the first and second types and belonging to a third circuit intended for the flow, over only a part of the length of the said member, in counter-current with the first and second fluids, of a third fluid (in particular a refrigerant mixture to be heated), the sealing means allotted to each passage of the third type leaving open an inlet and an outlet for the aforementioned mixture, at least one passage of a fourth type in a thermal exchange relation with at least one of the two passages of the first and second types, belonging to a fourth circuit intended to receive a fourth fluid (in particular an auxiliary refrigerant to be heated), the sealing means allotted to each passage of the fourth type leaving open, at the two ends of the latter, a first opening and a second opening respectively which are reserved for the auxiliary refrigerant, at least one passage of the fourth type adjacent to a passage of the third type extends over another part of the length of the said member, and at least one transverse partition which extends for the width of the said member separates the two passages respectively of the third and fourth types from one another.

BRIEF DESCRIPTION OF THE DRAWINGS

In order that the invention may be more clearyly understood, reference will now be made to the accompanying drawings, which show certain embodiments thereof by way of example only and in which.

DETAILED DESCRIPTION OF PREFERRED EMBODIMENTS

Figure 1:
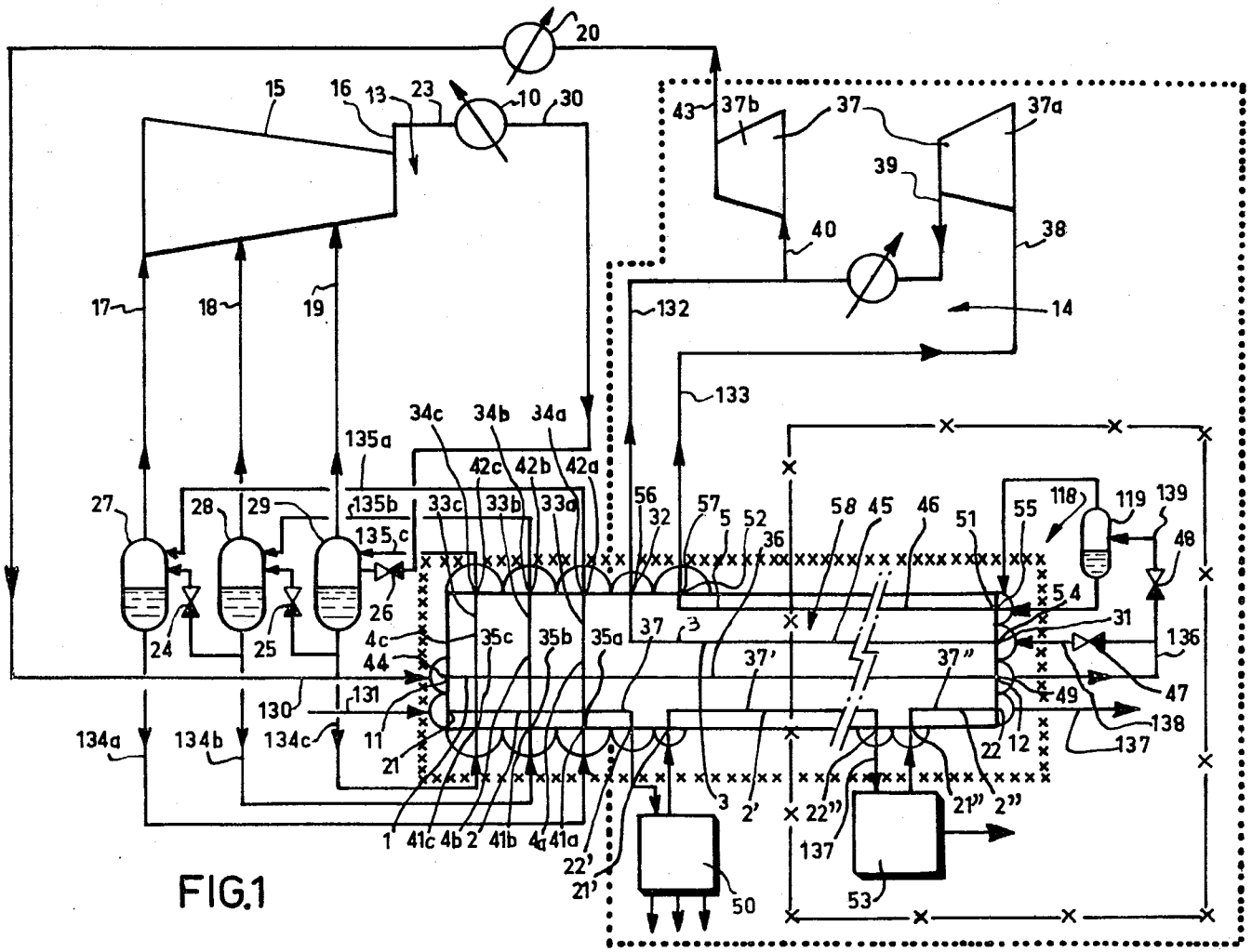
FIG. 1 is a schematic view of an installation for cooling a gas.
Figure 2:
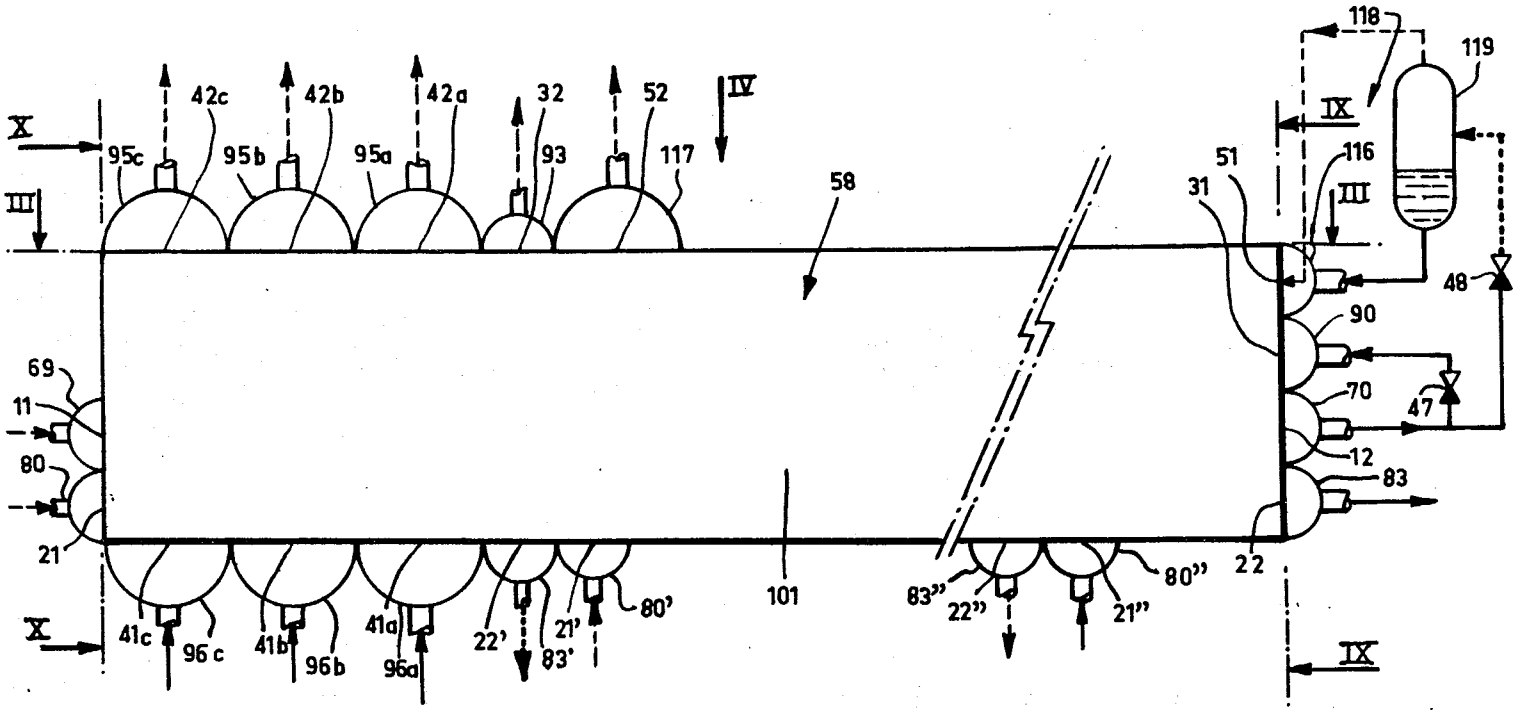
FIG. 2 is an elevation of this installation.
Figure 3:
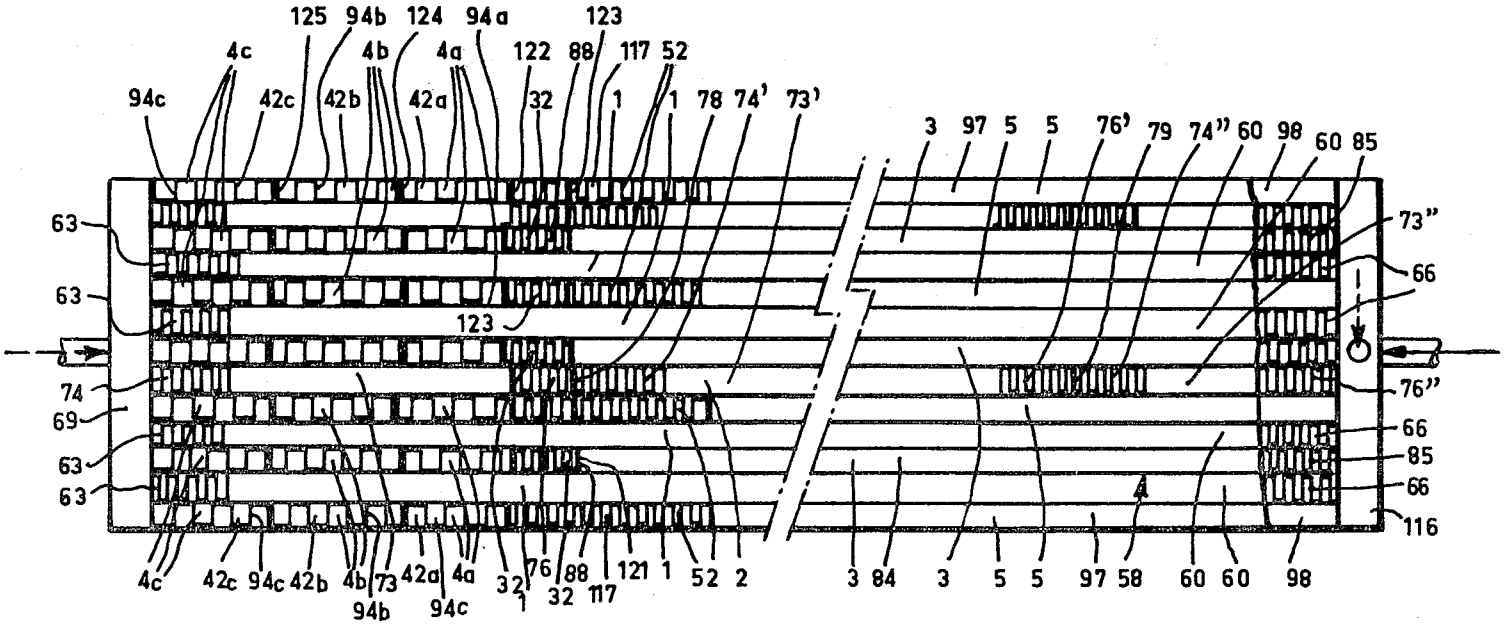
FIG. 3 is a sectional view, in the plane of section III—III of FIG. 2, of the thermal exchange member which forms part of the installation shown schematically in FIG. 1.
Figure 4:
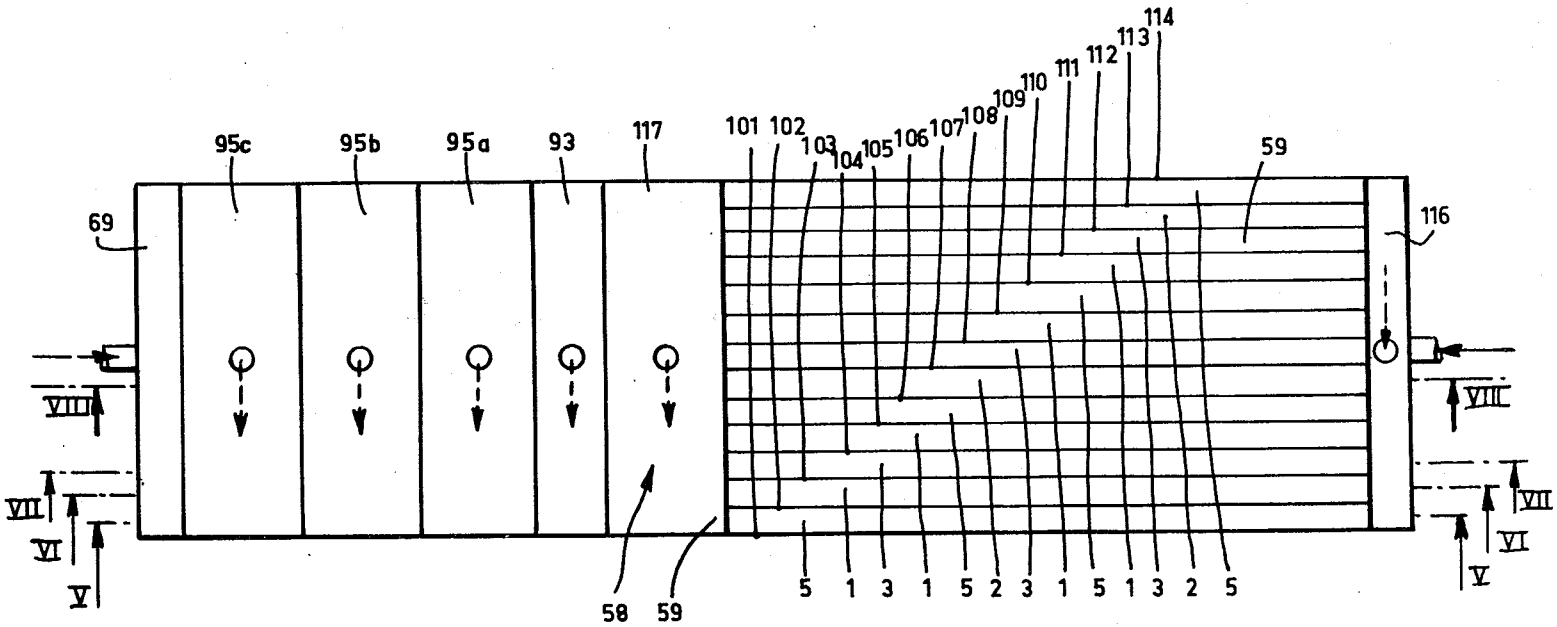
FIG. 4 is a view of the thermal exchange member which forms part of the installation shown schematically in FIG. 1, looking in the direction of the arrow IV in FIG. 2.

Referring now to the drawings, as shown in FIG. 1, a cooling installation according to the present invention comprises a sequence of at least two cooling circuits 13 and 14 which are thermally associated with one another in cascade.

The first cooling circuit 13 comprises:

a first compressor 15 to compress a single constituent auxiliary refrigerant (propane for example), with an outlet 16 for high pressure delivery, and three inlets 17, 18 and 19 for the induction of three vaporised portions of the auxiliary refrigerant respectively at a lower pressure, at a first intermediate pressure and at a second intermediate pressure lying between the said first intermediate pressure and the high pressure, a condenser 10 for the flow of an external coolant such as water, of which an inlet 23 communicates with the outlet 16 of the first compressor 15, on the one hand three means 26, 25 and 24 for the expansion of the condensed auxiliary refrigerant which are connected in series, and on the other hand three separators 27, 28 and 29 for separating the liquid and vapour phases of the auxiliary refrigerant respectively at the lower pressure, the first intermediate pressure and the second intermediate pressure. The inlet of the first expansion means 24 communicates indirectly with the outlet 30 of the condenser 10 via the second separator 28, the second expansion means 26, three passages of circuits 33*a*, 33*b*, 33*c* for the evaporation of the expanded auxiliary refrigerant at the lower pressure, the first intermediate pressure and the second intermediate pressure respectively, which are, in the direction of flow of the refrigerant mixture, in thermal exchange relation with a passage or circuit 36 for cooling the refrigerant mixture and a passage or circuit 37 for cooling the natural gas specified below.

The second cooling circuit 14 comprises:

a second compressor 37 having two stages of compression 37*a* and 37*b*; the first stage 37*a* has on the one hand an inlet 38 for the induction at a low pressure of a vaporised portion of the refrigerant mixture (the latter comprising methane, ethane, propane, butane and nitrogen) and on the other hand an outlet 39 for the delivery, at a pressure which hereinafter will be termed the evaporation pressure, of the abovementioned portion of the refrigerant mixture; the second stage 37*b* has on the one hand an inlet 40 for the induction, at the evaporation pressure, of the whole of the refrigerant mixture, this inlet 40 communicating with the outlet 39 of the first stage 37*a*, and on the other hand an outlet 43 for the delivery at a higher pressure of the compressed refrigerant mixture, a passage or circuit 36 for cooling the compressed refrigerant mixture in thermal exchange relation (in the direction of flow of the said refrigerant mixture) first of all with the three evaporation passage 33*c*, 33*b* and 33*a* of the first cooling circuit 13 in succession, then with both a passage or circuit 45 for heating the refrigerant mixture at the evaporation pressure and a passage or circuit 46 for heating the refrigerant mixture at the low pressure; the inlet 44 of the cooling passage 36 communicates with the outlet 43 of the second compressor 37, a second means 47 and a third means 48 for the expansion of the cooled refrigerant mixture to the aforementioned evaporation pressure and low pressure respectively; the two inlets of the two expansion means 47 and 48 communicate directly with the outlet 49 of the cooling passage 36, a passage or circuit 37 for cooling the natural gas to be cooled, which breaks down into three successive (in the direction of flow of the natural gas) sections 37, 37' and 37''; the cooling passage 37 is in thermal exchange relation first of all with the three evaporation passages 33*c*, 33*b* and 33*a*, and then with both the heating passages 45 and 46; the interruption between sections 37 and 37′ corresponds to the discharge of the partly cooled natural return from the said unit of a methane-rich gaseous fraction; the interruption between sections 37′ and 37″ corresponds to the discharge of substantially cooled natural gas to a nitrogen removal unit 53, and the return from the said unit of a nitrogen impoverised gaseous fraction.

As FIG. 1 shows, the various thermal exchange passages 35*a*, 35*b*, 35*c*, 36, 37, 45 and 46 are combined into one and the same thermal exchange member or assembly 58 of the plate heat-exchanger type, of brazed aluminium for example, which will now be explained in detail with reference to FIGS. 2 to 10 and which comprises:

a plurality, i.e. fourteen for example, of metal plates 101 to 114 of similar or even identical outline which extend in a first dimension, or length, and a second dimension, or width. The plates 101 to 114 are spaced apart from one another at regular and possibly constant intervals and are ranged parallel to one another in a third dimension or thickness, sealing means 59 (see FIG. 4) comprising various relatively narrow and thin rectangular metal strips which define, on the one hand, in conjunction with plates 101 to 114, a plurality of passages of rectangular shape which are described separately and defined individually below, and on the other hand, between them, a plurality of inlets to and outlets from the aforesaid passages, four passages 1 arranged in parallel, hereinafter termed passages of the first type, which are defined between plates 102 and 103, 104 and 105, 108 and 109, 110 and 111 respectively and which are shown in more detail in FIG. 6. These four passages 1 together from a first circuit intended for the flow, for the entire length of the member 58, of the refrigerant mixture to be cooled (the first fluid); the sealing means 59 allotted to each passage of the fourth type leave open, at the two ends of the latter, an inlet 11 and an outlet 12 respectively. To be more exact, each passage 1 is filled with a packing 60 consisting of a corrugated sheet, which is permeable chiefly or solely in the lengthwise direction of the member 58, the packing 60 being bounded, at the two ends of its lengthwise extent, on the one hand by three sections 63, 64 and 65 of corrugated sheet, which serve to distribute the refrigerant mixture to be cooled, and on the other hand by three sections 66, 67 and 68 of corrugated sheet which serve to collect the cooled refrigerant mixture. The inlets 11 to the various passages 1 of the first type communicate with the same single header 69 for the introduction of the refrigerant mixture to be cooled, while the outlets 12 from the various passages 1 of the first type communicate with the same single header 70 for the withdrawal of the cooled refrigerant mixture, two passage 2 arranged in parallel, which hereinafter will be referred to as passages of the second type, which are defined between plates 106 and 107, 112 and 113 respectively and which are shown in more detail in FIG. 8. Together, these two passages 2 form a second circuit intended for the flow, for the whole length of the member 58, of the natural gas to be cooled (the second fluid), in co-current with the refrigerant mixture to be cooled. The sealing means 59 allotted to each passage of the second type leave open, at the two ends of the latter, an inlet 21 for the natural gas to be cooled, and an outlet 22 for the cooled natural gas, respectively. To be more exact, each passage 2 of the second type breaks down, along the length of the thermal exchange member 58, into a first section 2, a second section 2′, and the third section 2″, with sections 2 and 2′ on the one hand, the sections 2′ and 2″ on the other hand, being separated by respective ones of two partitions 78 and 79, which extend for the whole width of the member 58 between the pair of consecutive plates (such as 106 and 107) which define the passage of the second type concerned. The first section 2 of each passage of the second type is intended for the flow of the natural gas to be cooled over a first part of the length of the member 58, and to be more exact it comprises on the one hand a packing 73 which is permeable mainly or solely in the direction of the said length and which consists of a corrugated sheet, and on the other hand two sections 74 and 75 of corrugated sheet which are situated at one end of the packing 73 and which serve to distribute the natural gas to be cooled, which enters through the inlet 21, and two sections 76 and 77 of corrugated sheet which are situated at the other end of the packing 73 and which serve to collect the partly cooled natural gas, which is withdrawn through an outlet 22′ into the separating unit 50. The second section 2′ of each passage of the second type is intended for the flow, over a second part of the length of the member 58, of partly cooled natural gas coming from unit 50, which is thus substantially enriched with methane. This second section comprises, to be more exact, on the one hand a packing 73′ which is permeable chiefly or solely in the lengthwise direction of the member 58 and which consists of corrugated sheet, and on the other hand two sections 74′ and 75′ of corrugated sheet which are situated at one end of the packing 73′ and which serve to distribute the substantially methane-enriched natural gas which enters through inlet 21′, and two sections 76′ and 77′ of corrugated sheet which are situated at the other end of the packing 73′ and which serve to collect the substantially cooled natural gas, which is withdrawn through outlet 22″ to the nitrogen removal unit 53. The third and last section 2″ of each passage of the second type is intended for the flow, over the last part of the length of the member 58, of nitrogen-depleted natural gas coming from the nitrogen removal unit 53. To be more exact, this last section 2″ comprises on the one hand a packing 73″ which is permeable chiefly or solely in the lengthwise direction of the member 58 and which consists of a corrugated sheet which are situated at one end of the packing 73″ and which serve to distribute the nitrogen-depleted natural gas entering through inlet 21″, and two sections 76″ and 77″ of corrugated sheet which are situated at the other end of the packing 73″ and which serve to collect the completely cooled nitrogen-depleted natural gas, which is removed through outlet 22. All the inlets 21, 21′ and 21″ belonging to the various passages 2 of the second type communicate with inlet headers for the natural gas, which are indicated by reference numerals 80, 80′ and 80″ respectively. All the outlets 22, 22′ and 22″ belonging to the various passages 2 of the second type communicate with outlet headers for the natural gas, which are indicated by reference numerals 83, 83′ and 83″ respectively.

three passages 3 arranged in parallel, which are referred to hereinafter as passages of the third type, which are defined between metal plates 103 and 104, 107 and 108, and 11 and 112 respectively and which are shown in more detail in FIG. 7. These three passages 3 together form a third circuit intended for the flow, over part of the length of the thermal exchange member 58, of the refrigerant mixture to be heated (the third fluid) at the evaporation pressure. Each passage of the third type, such as that contained between metal plates 107 and 108 for example, is in thermal exchange relation with both a passage 1 of the first type and a passage 2 of the second type. The sealing means allotted to each passage of the third type leave open, at the two ends of the latter, an inlet 31 for the refrigerant mixture to be heated at the evaporation pressure and an outlet 32 for the heated refrigerant mixture, respectively. To be more exact, each passage 3 is filled with a packing 84 which is permeable chiefly or solely in the lengthwise direction of the member 58 and which consists of a corrugated sheet, this packing being bounded at the two ends lengthwise on the one hand by three sections 85, 86 and 87 of corrugated sheet which serve to distribute the refrigerant mixture to be heated at the evaporation pressure and on the other hand by two sections 88 and 89 of corrugated sheet which serve to collect the heated refrigerant mixture. The inlets 31 to the various passages 3 of the third type communicate with one and the same inlet header 90 for the refrigerant mixture to be heated, while the outlets 32 of the various passages 3 of the third type communicate with one and the same outlet header 93 for the cooled refrigerant mixture.

seven passages 4*a* which are defined between metal plates 101 and 102, 103 and 104, 105 and 106, 107 and 108, 109 and 110, 111 and 112, and 113 and 114 respectively and which will hereinafter be referred to as passages of the fourth type; seven passages 4*b* which are respectively defined between the same plates as those defined above and which will be referred to hereinafter as supplementary passages of the fourth type; and seven passages 4*c* which are respectively defined between the same plates as those defined above and which will be referred to hereinafter as additional passages of the fourth type. Each passage 4*a* of the fourth type, such as that contained between plates 105 and 106, is in thermal exchange relation both with a passage 1 of the first type and with a passage 2 of the second type. The same is also true of each supplementary passage 4*b* of the fourth type and each additional passage 4*c* of the fourth type. The seven passages 4*a*, the seven supplementary passages 4*b* and the seven additional passages 4*c* respectively form a fourth circuit, a so-called supplementary fourth circuit, and a so-called additional fourth circuit, all three of which are intended for the reception of auxiliary refrigerant (propane) in liquid form to be heated, and to be more exact for the evaporation of the said refrigerant at, respectively, the lower pressure (auxiliary refrigerant or fourth fluid), the first intermediate pressure (supplementary auxiliary refrigerant or supplementary fourth fluid) and the second intermediate pressure (additional auxiliary refrigerant or additional fourth fluid) in cross-flow with the refrigerant mixture and the natural gas to be cooled. The sealing means 59 allotted to the three passages 4*a*, 4*b*, 4*c* of the fourth type leave open, at the two ends of the latter, on the one hand first openings or inlets 41*a*, 41*b* and 41*c* respectivley, and on the other hand second openings or outlets 42*a*, 42*b* and 42*c* respectively. Each passage 4*a*, 4*b*, 4*c* of the fourth type is arranged to receive auxiliary refrigerant (fourth fluid) in the widthwise direction of the thermal exchange member 58, and to this end it contains (see FIGS. 5 and 7) a packing 94*a*, 94*b* or 94*c* which is permeable chiefly or solely over the entire width of the member 58. The said packing consists of a corrugated sheet which opens, over the whole of its cross-section and not via collection and distributing means, to the outside of the thermal exchange member 58. The inlets 41*a*, 41*b* and 41*c* all communicate with inlet headers for the auxiliary refrigerant (96*a*, 96*b* and 96*c* respectively) while the outlets 42*a*, 42*b* and 42*c* all communicate with outlet headers 95*a*, 95*b* and 95*c* for the auxiliary refrigerant.

four passages 5, which will be referred to hereinafter as passages of the fifth type, which are respectively defined between plates 101 and 102, 105 and 106, 109 and 110, and 113 and 114 and which are shown in detail in FIG. 5. Together the four passages 5 form a fifth circuit intended for the flow, over part of the length of the thermal exchange member 58, of the refrigerant mixture to be heated at the low pressure (fifth fluid), in counter-current to the refrigerant mixture and natural gas to be cooled and in co-current with the refrigerant mixture to be heated at the evaporation pressure. Each passage 5 of the fifth type, for example that contained between plates 105 and 106, is in thermal exchange relation with a passage 1 of the first type and a passage 2 of the second type. The sealing means 59 allotted to each passage of the fifth type leave open, at the two ends of the latter, respectively an inlet 51 for the refrigerant mixture to be heated at the low pressure, and an outlet 52 for the heated refrigerant mixture. To be more exact, each passage 5 of the fifth type is filled with a packing 97 which is permeable chiefly or solely in the lengthwise direction of the member 58 and which consists of a corrugated sheet, the packing being bounded at the two ends lengthwise on the one hand by two sections 98 and 99 of corrugated sheet which serve to distribute the refrigerant mixture to be heated at the low pressure, and on the other hand by two sections 100 and 115 of corrugated sheet which serve to collect the heated refrigerant mixture at the low pressure. The inlets 51 to the various passage 5 communicate with one and the same inlet header 116 for the refrigerant mixture at the low pressure, while the outlets 52 of the various fifth passages 5 communicate with one and the same outlet header for the refrigerant mixture at the low pressure, an arrangement 118 for di-phase distribution, which enables the vapour and liquid phases of the refrigerant mixture at the low pressure to be uniformly distributed between the various passages 5 of the fifth type in the thermal exchange member 58. This arrangement 118 is associated with the inlets 51 to all the passage 5 and comprises, on the one hand a separator 119 which enables the gaseous and liquid phases of the refrigerant mixture at the low pressure to be separated, and on the other hand a distributor 120 (see FIG. 5) which enables the vapour phase of the said refrigerant mixture to be uniformly distributed between the various inlets 51. The di-phase inlet of the separator 119 communicates with the outlet of the second expansion means 48, while the outlet for liquid and the outlet for vapour of the same separator 119 communicate with the inlet header 116 and the gas distributor 120 respectively.

Figure 5:
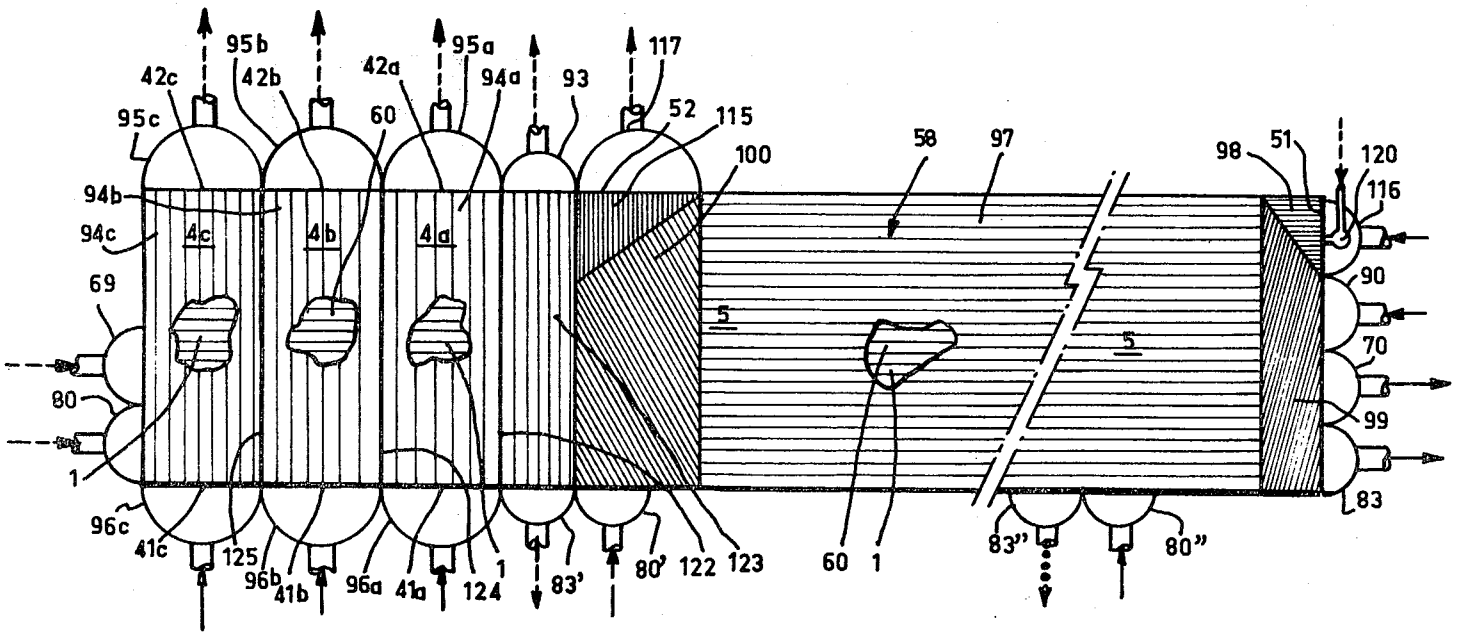
FIG. 5 is a sectional view, in the plane of V/V indicated in FIG. 4, of the above-mentioned thermal exchange member.
Figure 6:
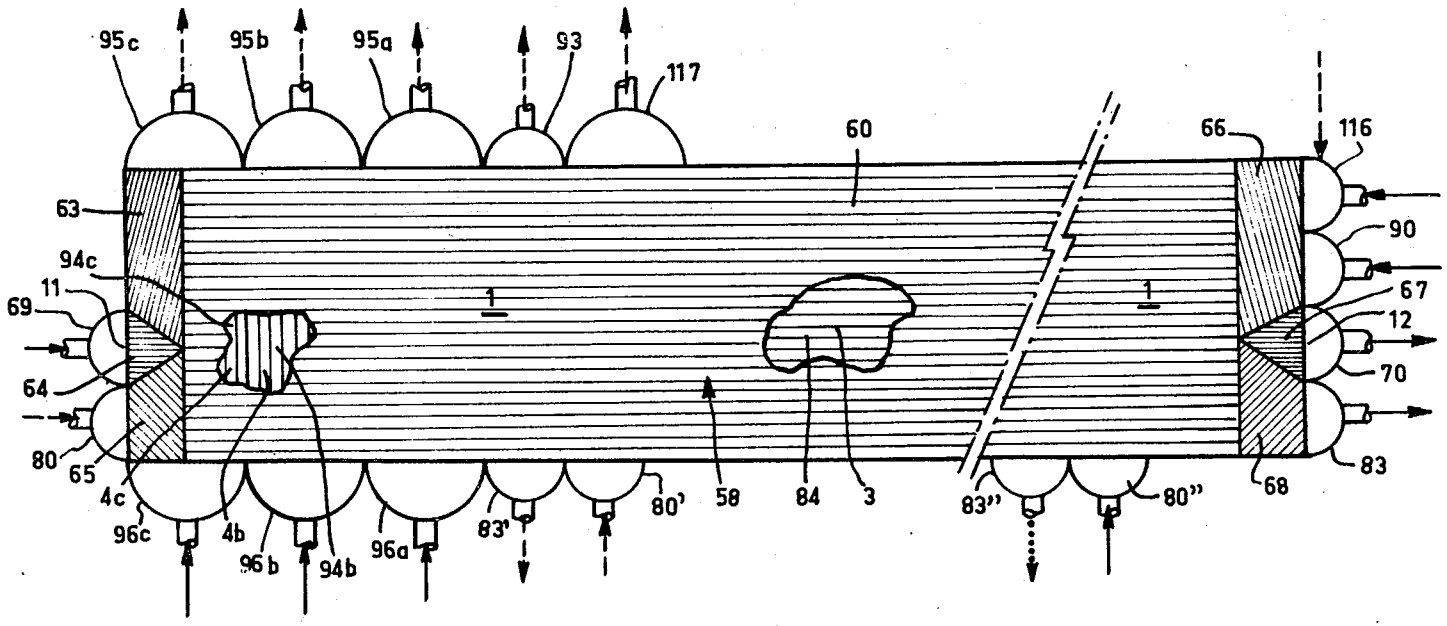
FIG. 6 is a sectional view, in the plane of section VI/VI indicated in FIG. 4, of the above-mentioned thermal exchange member.
Figure 7:
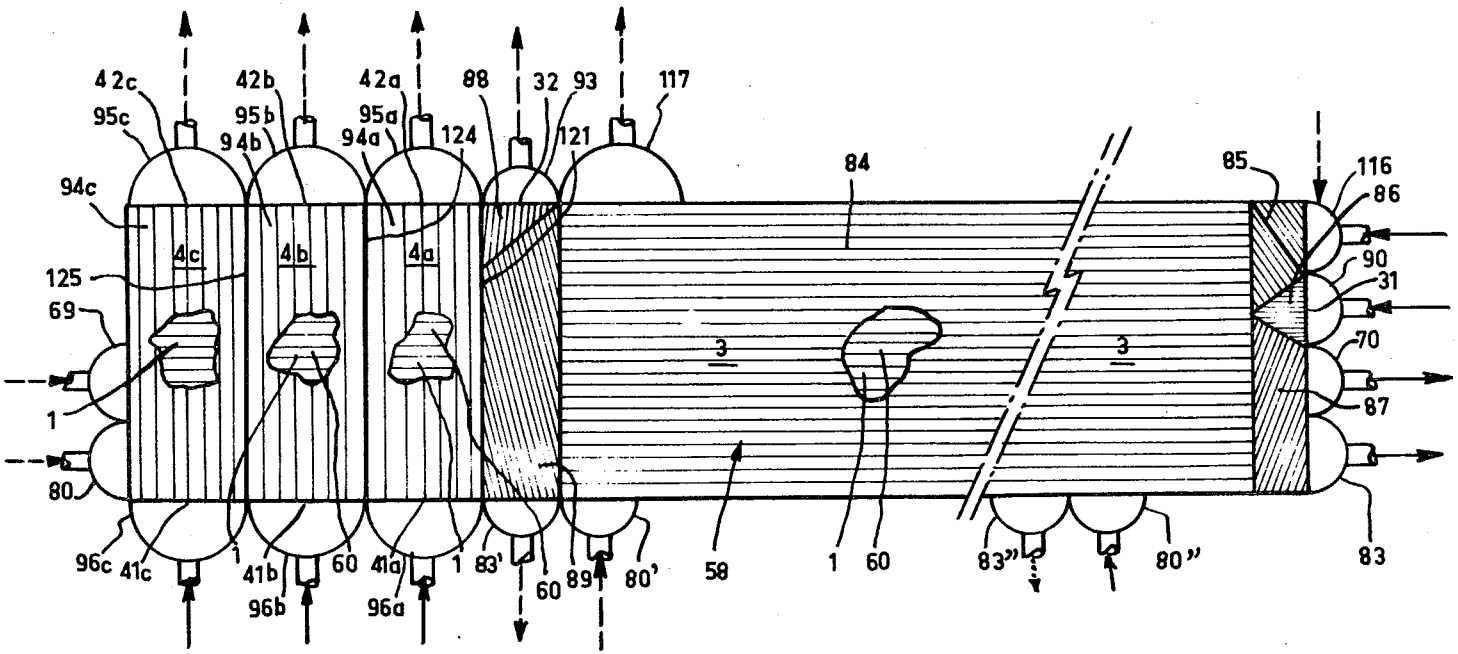
FIG. 7 is a sectional view, in the plane of section VII/VII indicated in FIG. 4, of the above-mentioned thermal exchange member.
Figure 8:
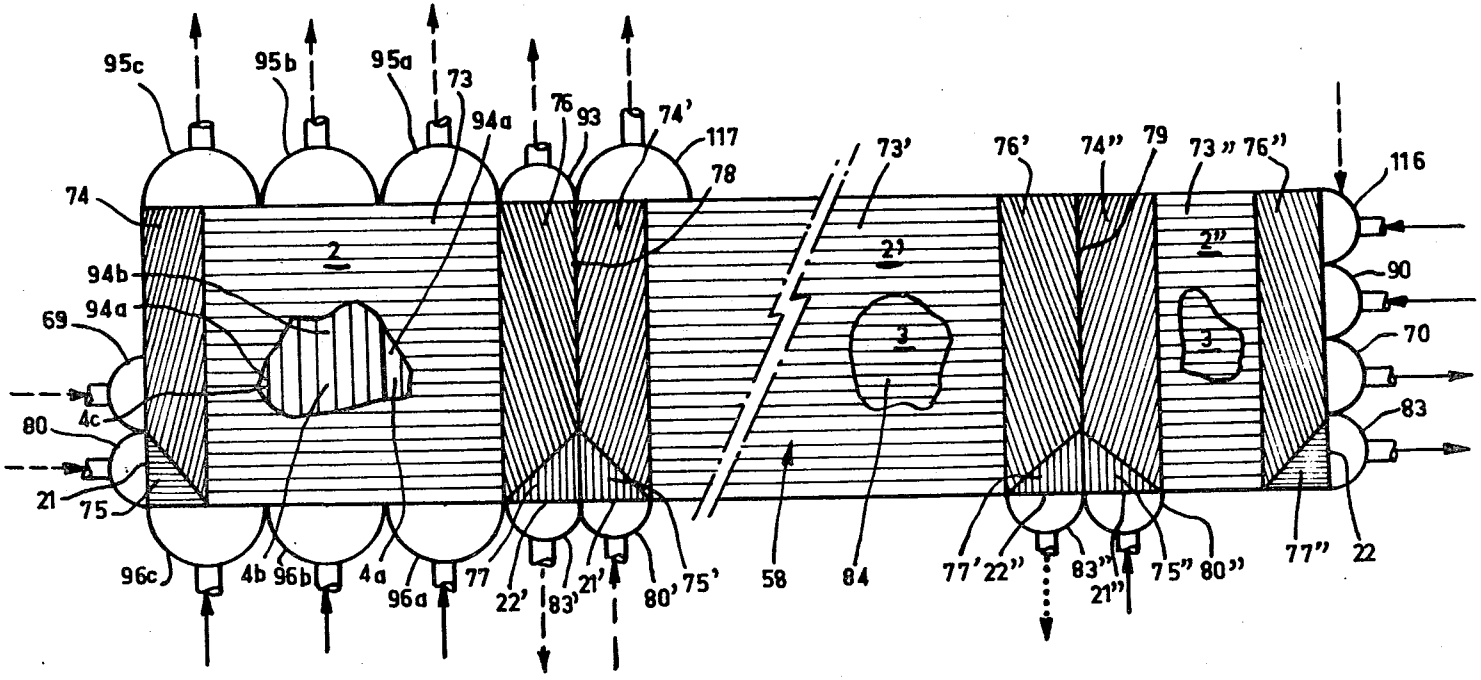
FIG. 8 is a sectional view, in the plane of section VIII/VIII indicated in FIG. 4, of the above-mentioned thermal exchange member.
Figure 10:
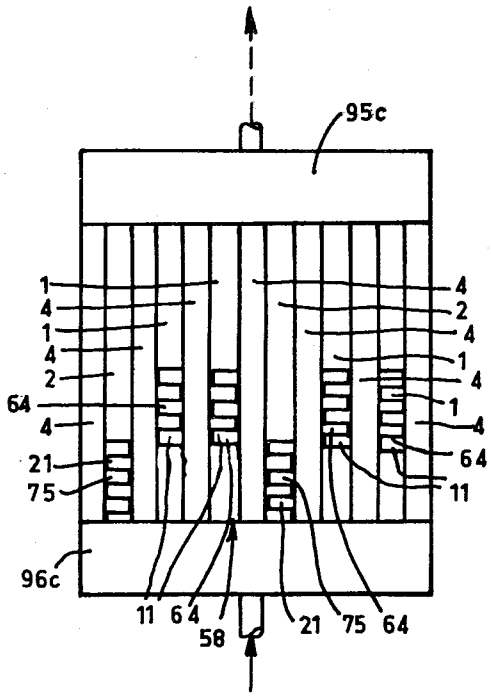
FIG. 10 is a sectional view, in the plane of section X/X indicated in FIG. 2, of the same thermal exchange member.
Figure 9:
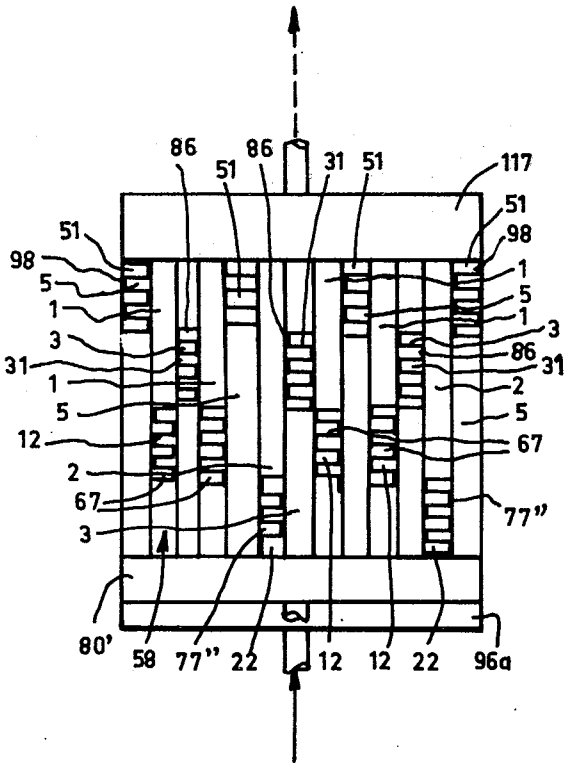
FIG. 9 is a sectional view, in the plane of section IX/IX indicated in FIG. 2, of the same thermal exchange member.

It should also be mentioned that the thermal exchange member 58 has the following special features:

as shown in FIG. 7, the passages 3 of the third type extend in the first dimension of the member 58 from the inlet end 31 for only a part of the length of the member 58, and at least one passage 4*a* of the fourth type adjacent to a passage 3 extends in the first dimension of the member 58 for another part of the length of the member 58, and a transverse partition 121 separates pairs of passages 3 and 4a.

as shown in FIG. 5, the passages 5 of the fifth type extend in the first dimension of the member 58 from the inlet end 51 for only a part of the length of the member 58, while at least one passage 4a of the fourth type adjacent to a passage 5 extends in the first dimension of the member 58 for another part of the length of the member 58, and a transverse partition 122 separates pairs of passage 5 and 4a. It should be mentioned that a packing 123 is arranged in each passage 5 of the fifth type between the partition 122 and the sections 100 and 115 to provide mechanical cohesion in the exchanger 58.

the passages 4b and 4c each extend in the first dimension of the member 58 for respectively a supplementary part and the remaining part of the length of the member 58, and two partitions 124 and 125 respectively separate the passage 4a from the supplementary passage 4b, and the latter from the additional passage 4c.

In conclusion, and returning to the view shown in FIG. 1, it will be appreciated that:

the circuit or passage 36 for cooling the refrigerant mixture at the upper pressure corresponds to the first circuit (passages 1 of the first type) in the thermal exchange member 58.

the circuit or passage 37 for cooling the natural gas corresponds to the second circuit (passages 2 of the second type) in the member 58, the circuit of passage 45 for heating the refrigerant mixture at the evaporation pressure corresponds to the third circuit (passages 3 of the third type) in the member 58, the three evaporation passages or circuits 33a, 33b and 33c correspond respectively to the fourth circuit (passages 4a of the fourth type) in the thermal exchange member, to the supplementary fourth circuit (supplementary passages 4b of the fourth type) in the thermal exchange member 58, and to the additional fourth circuit (additional passages 4c of the fourth type) in the member 58, the circuit or passage 46 for heating the refrigerant mixture at the low pressure corresponds to the fifth circuit (passage 5 of the fifth type) in the thermal exchange 58.

The result of the arrangement of the thermal exchange passages within the member 58 is that:

the circuit or passage 36 for cooling the refrigerant mixture is in continuous thermal exchange relation firstly with three successive circuits or passages 33c, 33b and 33a for the evaporation of the auxiliary refrigerant, then with both the passages or circuits 45 and 46 for heating the refrigerant mixture, at the evaporation pressure and the low pressure respectively, the circuits or passages 45 and 46 for heating the refrigerant mixture are in thermal exchange relation with both the passage or circuit 36 for cooling the refrigerant mixture and the passage or circuit 37 for cooling the natural gas.

The cooling installation which has just been described enables the method of cooling described below to be put into effect, which method consists of a succession of at least two cooling cycles 13 and 14, which are thermally associated with one another in cascade.

In the first cooling cycle 13, cyclically and successively:

334,500 $Nm^3/h$ of propane(auxiliary refrigerant) is compressed to a high pressure of 14.1 absolute atmospheres (atas) in the first compressor 15.

the compressed propane is condensed in the condenser 10 by heat exchange with water (the external refrigerant) in such a way that the temperature reached at the outlet from the said condenser is of the order 32° C., by using the three expansion means 24, 25 and 26, the condensed refrigerant mixture is expanded in series to the lower pressure (1.4 atas), to the first intermediate pressure (2.87 atas), and to the second intermediate pressure (6.52 atas) as defined above, respectively, in the evaporation circuits 33a, 33b and 33c, a first portion (92,500 $Nm^3/h$) of the expand refrigerant mixture at a temperature of −34° C., a second portion (145,500 $Nm^3/h$) at a temperature of −15° C., and a third portion (96,500 $Nm^3/h$) at a temperature of 11° C. are evaporated at the lower pressure, the first intermediate pressure, and the second intermediate pressure respectively, by cross-current heat exchange with the refrigerant mixture in the second cooling cycle 14 and the natural gas, in the course of cooling in circuits 36 and 37 respectively, by induction at inlets 17, 18 and 19, of the first compressor 15, the three evaporated portions of propane defined above are recompressed to the high pressure.

In the second cooling cycle, cyclically and successively:

using the compressor 37, a refrigerant mixture, comprising by volume 33.5% methane, 33.5% ethane, 10% propane, 1% butane, and 20% nitrogen is compressed to the upper pressure of 38.2 atas; the refrigerant mixture so compressed, i.e. 470,000 $Nm^3/h$ is cooled (without even partial condensation) to a temperature of 32° C. by the condensor 20.

the refrigerant mixture so compressed is cooled to −166° C., with no discontinuity, in the cooling circuit 36, first by cross-current heat exchange with the three portions of propane mentioned above, which are successively in the direction of flow of the refrigerant mixture in course of evaporation at the second intermediate pressure, the first intermediate pressure and the lower pressure, in evaporation ion circuits 33c, 33b and 33a respectively, then by counter-current heat exchange with the part and the other part (as defined below) of the refrigerant mixture which are flowing, in circuits 45 and 46 respectively, at the evaporation pressure and the low pressure respectively, a part and another part of the refrigerant mixture so cooled are expanded, by expansion means 47 and 48 respectively, to the evaporation pressure and the low pressure respectively:

the part (320,000 $Nm^3/h$) of the refrigerant mixture coming from the expansion means 47 is heated to −33° C., and the other part (150,000 $Nm^3/h$) of the same mixture coming from the expansion means 48 is heated to between −33° C. and −80° C., in the heating duct 45 at the evaporation pressure (5.5 atas) and in the heating duct 46 at the low pressure (1.5 atas) respectively, by countercurrent heat exchange with both the refrigerant mixture (flowing in duct 36) and the natural gas (flowing in duct 36) which are continuing their respective cooling after having undergone heat exchange with the propane in course of evaporation, using the second compressor 37, the two parts of the refrigerant mixture which are heated at the evaporation pressure and the low pressure respectively, are recompressed to the upper pressure.

As regards the second cooling cycle 14, it should be mentioned that at least one of the following parameters, namely the nature of the various constituents of the refrigerant mixture, the respective percentages of the latter in the composition of the refrigerant mixture, the upper delivery pressure of compressor 37, the induction pressure of the second compression stage 37*b*, the induction pressure of the first compression stage 37*a*, is selected in such a way that:

after the heat exchange which takes place in cross-current with the propane in course of evaporation (at three different pressures), the initial part of the subsequent cooling of the refrigerant mixture (in circuit 36 and thus within the various passages 1 of member 58) and of the natural gas (in circuit 37 and thus within the various passages 2 in member 58) is performed on the one hand by a main input of cooling energy from the part of the refrigerant mixture which is being heated in circuit 45 (and thus within the various passages in member 58) at the above-mentioned evaporation pressure, and on the other hand by a secondary input of cooling energy from the other part of the same refrigerant mixture which is being heated in circuit 46 (and thus within the various passages 5 in member 58) at the above-mentioned low pressure, and the final part of the cooling of the refrigerant mixture and the natural gas is performed on the one hand by a main input of cooling energy from the other part of the refrigerant mixture which is being heated in circuit 46 (and thus within the various passages 5 in member 58) at the low pressure, and on the other hand by a secondary input of cooling energy from the part of the refrigerant mixture which is being heated in circuit 45 (and thus within the various passages 3 in member 58) at the above-mentioned evaporation pressure.

In other words, the conditions of operation defined above mean that:

the initial part of the cooling defined above is performed in essence by heat exchange with the part of the refrigerant mixture in course of evaporation at the said evaporation pressure, while the final part of the cooling in question is performed in essence by heat exchange with the part of the refrigerant mixture in course of evaporation at the said low pressure, and, in the final part of the cooling in question, the refrigerant mixture is sub-cooled (in circuit 36) on the one hand principally by heat exchange with the refrigerant mixture in course of evaporation at the low pressure, and on the other hand, subsidiarily, by heat exchange with the refrigerant mixture in liquid form in course of heating at the evaporation pressure; and, after expansion in valves 47 and 48, the refrigerant mixture is thus obtained in the form of a pure liquid and in the from of a di-phase mixture at the evaporation pressure and the low pressure respectively.

It is found that if the mass flow of the part of the refrigerant mixture which is heated at the evaporation pressure is substantially greater than the mass flow of the other part of the refrigerant mixture which is heated at the low pressure (this condition of operation being satisfied in the present case), the problem of distributing a di-phase fluid entering the exchanger 58 is confined to a relatively small part of the total flow of the refrigerant mixture and is thus considerably simplified.

Figure 17:
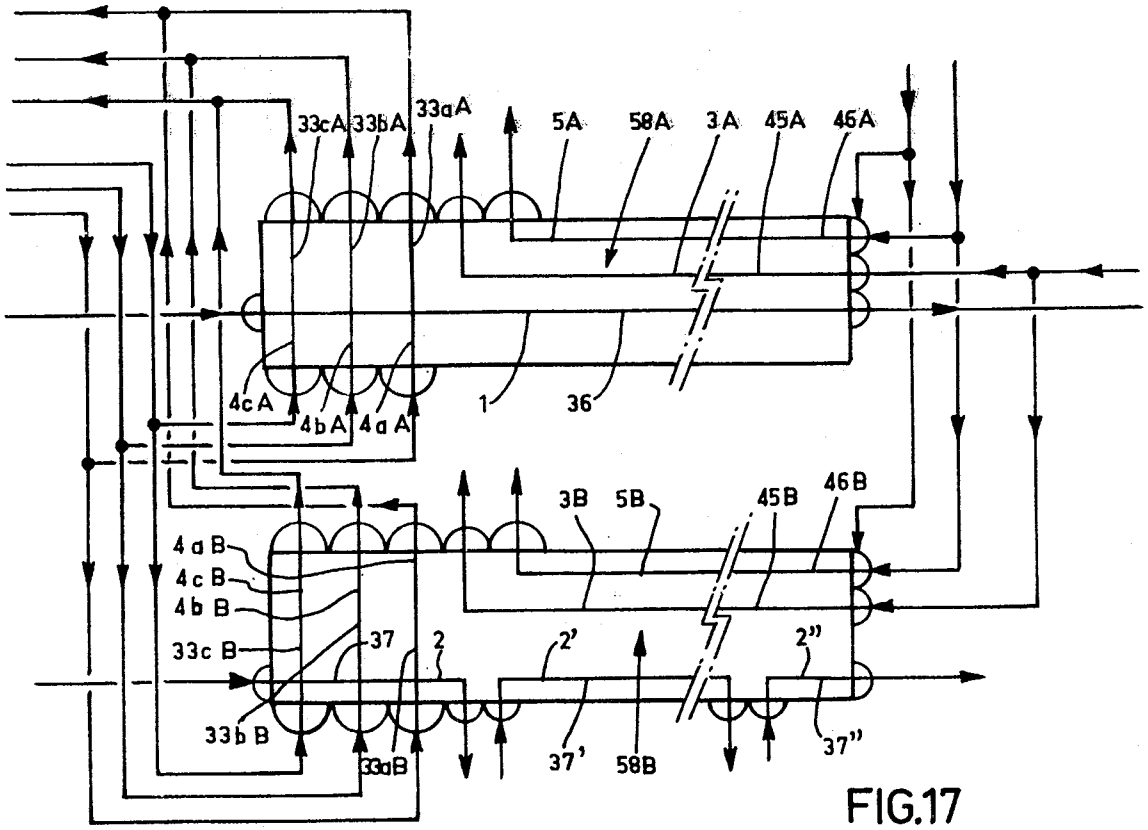
FIG. 17 shows another embodiment of the cooling installation shown schematically in FIG. 1, relating only to the part of the latter bounded by the line made up of crosses.

Various modifications may be made to the cooling installation which has been described above with reference to FIGS. 1 to 10:

the thermal exchange assembly 58, rather than being arranged vertically, plates 101 to 114 being vertical, may be arranged horizontally, plates 101 to 114 being horizontal, as shown in FIG. 17, the thermal exchange assembly 58 may comprise two thermal exchange members 58A and 58B of differing structure in parallel. In elementary terms, the first member 58A comprises at least one passage 1 of the first type, at least one passage 3A of the third type, at least one passage 4A of the fourth type and at least one passage 5A of the fifth type. In elementary terms, the second member 58B comprises at least one passage 2 of the second type, at least one passage 3B of the third type, at least one passage 4B of the fourth type and at least one passage 5 of the fifth type.

Other embodiments of the present invention will now be described with reference to FIGS. 11 to 16, in which the same reference numberals as are found in FIGS. 1 to 10 refer to structural components which are the same and/or have the same function.

Figure 11:
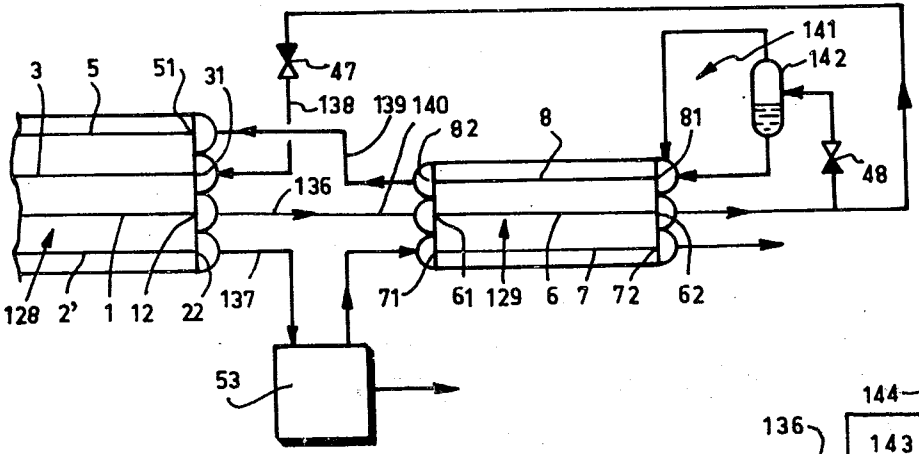
FIG. 11 is a schematic view of another embodiment of the cooling installation shown schematically in FIG. 1, relating only to the part of the latter which is contained within the solid-line rectangle divided up by crosses.
Figure 12:
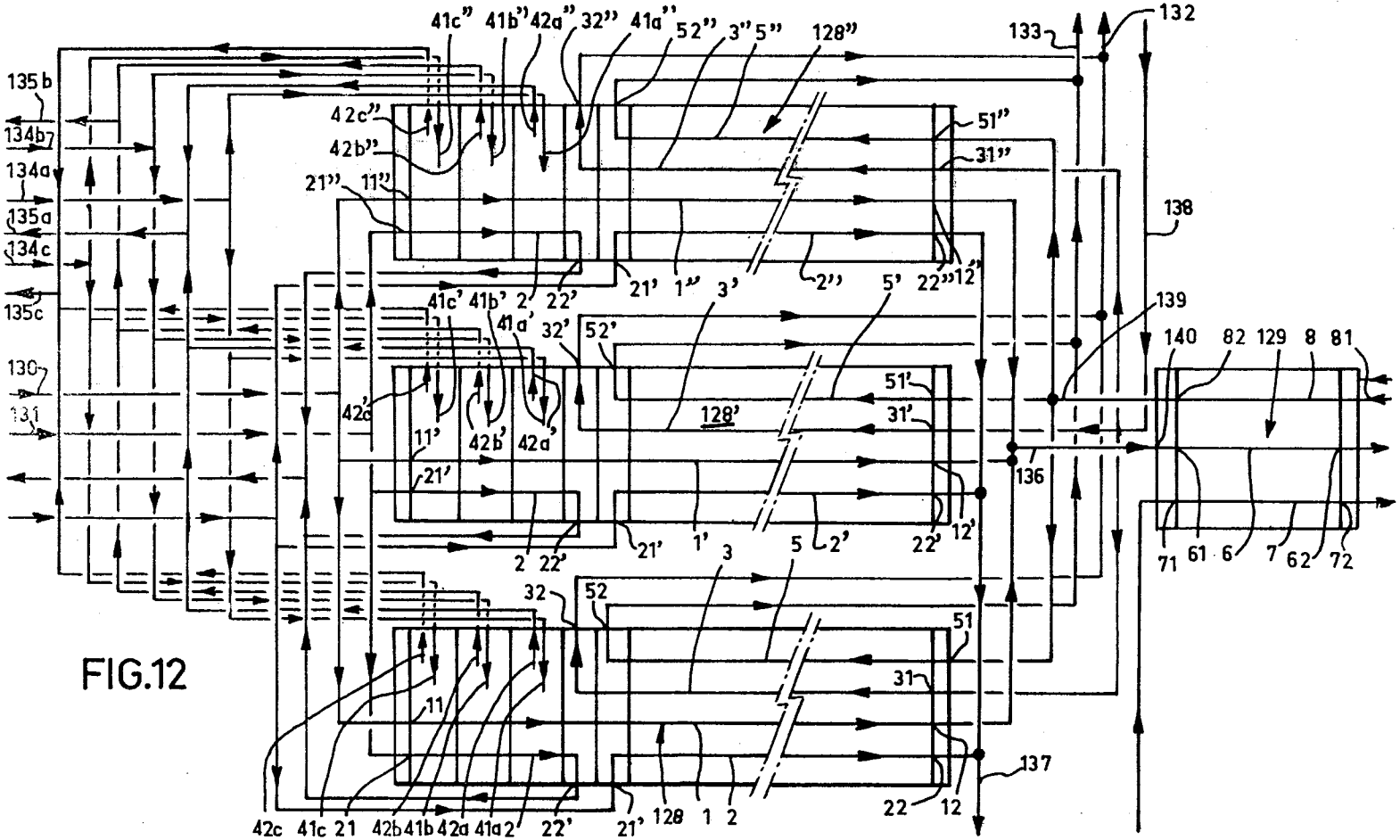
FIG. 12 is a schematic view of a modified form of the embodiment shown in FIG. 11.

Referring to FIGS. 11 and 12, another thermal exchange assembly according to the present invention of the plate heat-exchanger kind is distinguished from the assembly described above with reference to FIGS. 1 to 10 by virtue of the fact that it comprises:

a plurality, three for example, of initial thermal exchange members 128, each similar if not identical to the thermal exchange member 58 described with reference to FIGS. 1 to 10, the three members 128, 128' and 128'' being connected in parallel with one another: the inlets 11, 11' and 11'' to the various passages 1, 1' and 1'' of the first type are connected in parallel to one and the same duct 130 for supplying gaseous refrigerant mixture (the first fluid) at the upper pressure. The inlets 21, 21' and 21'' to the various passages 2, 2' and 2'' of the second type are connected in parallel to one and the same duct 131 for supplying natural gas (the second fluid). The outlets 32, 32' and 32'' of the various passages 3, 3' and 3'' of the third type are connected in parallel to one and the same duct 132 for the removal of the heated refrigerant mixture (the third fluid) at the evaporation pressure. The outlets 52, 52' and 52'' of the various passages 5, 5' and 5'' of the fifth type are connected in parallel to one and the same duct 133 for the removal of the heated refrigerant mixture (the fifth fluid) at the low pressure. The first openings 41*a*, 41*a'*, 41*a''* (41*b*, 41*b'*, 41*b''* and 41*c*, 41*c'*, 41*c''*) of the various passages 4*a*, 4*a'*, 4*a''*(4*b*, 4*b'*, 4*b''* and 4*c*, 4*c'*, 4*c''*) of the fourth type are connected in parallel to one and the same duct 134*a* (134*b*, 134*c*) for supplying evaporated propane (the fourth fluid) at the lower pressure (the first intermediate pressure, the second intermediate pressure). The second openings 42*a*, 42*a'*, 42*a''*(42*b*, 42*b'*, 42*b''* and 42*c*, 42*c'*, 42*c''*) of the various passages 4*a*, 4*a'*, 4*a''* (4*b*, 4*b'*, 4*b''* and 4*c*, 4*c'*, 4*c''*) of the fourth type are connected in parallel to one and the same duct 135*a* (135*b*, 135*c*) for the removal of liquid propane (the fourth fluid) at the lower pressure (the first intermediate pressure, the second intermediate pressure). The outlets 12, 12' and 12'' of the various passages 1, 1', 1'' of the first type are connected in parallel to one and the same means or duct 136 for the extraction of cooled refrigerant mixture (the first fluid) at the upper pressure. The outlets 22, 22', 22'' of the various passages 2, 2', 2'' of the second type are connected in parallel to one and the same duct 137 for the removal of cooled natural gas (the second fluid) to the nitrogen removal unit 53. The inlets 31, 31', 31'' of the various passages 3, 3', 3'' of the third type are connected in parallel to one and the same means 138 for supplying cooled refrigerant mixture (the third fluid) at the evaporation pressure. The inlets 51, 51', 51'' to the various passages 5, 5', 5'' of the fifth type belonging to the various initial members 158 158', 158'' are connected in parallel to a means 139 for supplying refrigerant mixture (the fifth fluid) at the low pressure, a number of final thermal exchange members fewer than the number of initial thermal exchange members, for example a single final thermal exchange member 129, of the plate heat exchanger kind, which is connected in series with the various initial thermal exchange members 128, 128', 128'', at least one passage 6 of a sixth type belonging to a sixth circuit intended for the flow, for the whole length of the final member 129, of the refrigerant mixture at the upper pressure which is completing its cooling (the sixth fluid). The sealing means (not shown) allotted to each passage 6 of the sixth type leave open, at the two ends of the latter, an inlet 61 and an outlet 62 respectively for the refrigerant mixture at the upper pressure, at least one passage 7 of a seventh type belonging to a seventh circuit intended for the flow, for the whole length of the final member 129 in co-current with the refrigerant mixture at the upper pressure completing its cooling, of the natural gas which is also completing its cooling (the seventh fluid). The sealing means allotted to each passage 7 of the seventh type leave open at the two ends of the latter an inlet 71 and an outlet 72 respectively for the natural gas.

at least one passage 8 of an eighth type, in thermal exchange relation with both the two passages 6 and 7 respectively of the sixth and seventh types, which is intended for the flow, for the whole length of the final member 129 in counter-current to the refrigerant mixture and natural gas to be cooled, of the refrigerant mixture at the low pressure to be heated (eighth fluid). The sealing means (not shown) allotted to each passage 8 of the eighth type leave open, at the two ends of the latter, an inlet 81 and an outlet 82 respectively for the refrigerant mixture at the low pressure.

an arrangement 141 for di-phase distribution is associated with the inlets 81 and enables the vapour and liquid phase of the di-phase refrigerant mixture at the low pressure to be uniformly distributed between the various passages of the eighth type in the member 129. The arrangement 141 comprises a separator 142 and a gas distribution device (not shown).

the inlets 61 to the various passage 6 of the sixth type in the final thermal exchange member 129 communicate with a means 140 for supplying cooled refrigerant mixture. The inlets 71 to the various passages of the seventh type in the final member 129 communicate indirectly with the duct 137 for the extraction of the natural gas from the initial members 128, via the nitrogen removal unit 53. The outlets 82 of the various passages 8 of the eighth type in the final member 129 communicate directly with the means 139 for supplying the various initial members 128, 128', 128'' with refrigerant mixture at the low pressure. The means 138 for supplying refrigerant mixture at the evaporation pressure communicate indirectly, without passing through the final member 129, via the first expansion means 47, with the outlets 62 of the various passages 6 of the sixth type in the final member 129. The inlets 81 to the various passages 8 of the eighth type in the final member 129 communicate indirectly, via the second expansion means 48, with all the outlets 62 of the various passages 6 of the sixth type in the final member 129.

Figure 13:
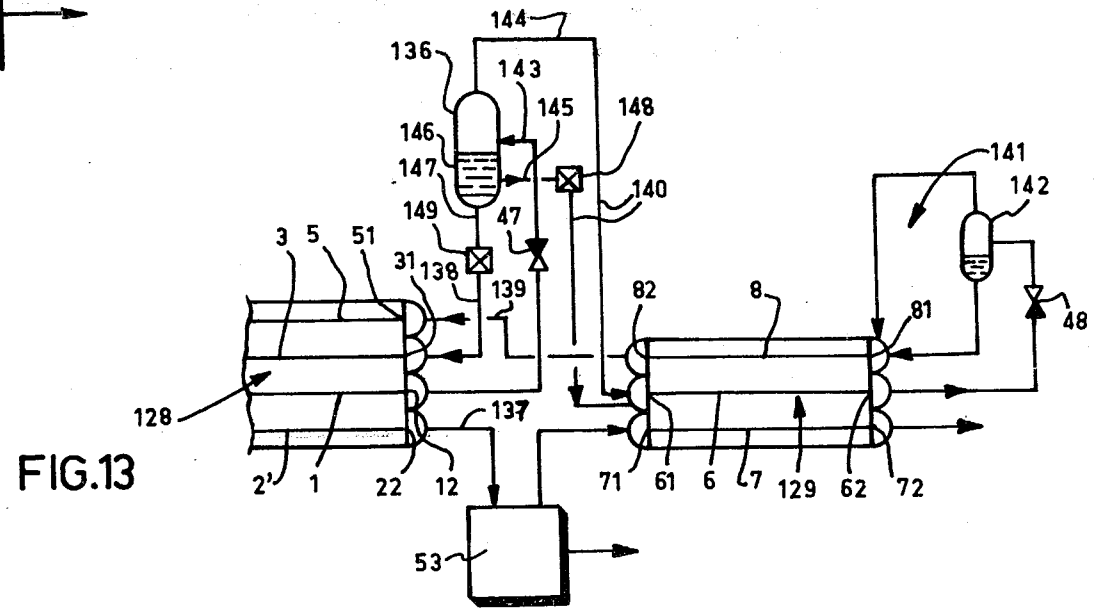
FIG. 13 shows yet another embodiment of the cooling installation shown schematically in FIG. 1, relating only to the part of the latter which is contained within the solid-line rectangle divided up by crosses.
Figure 14:
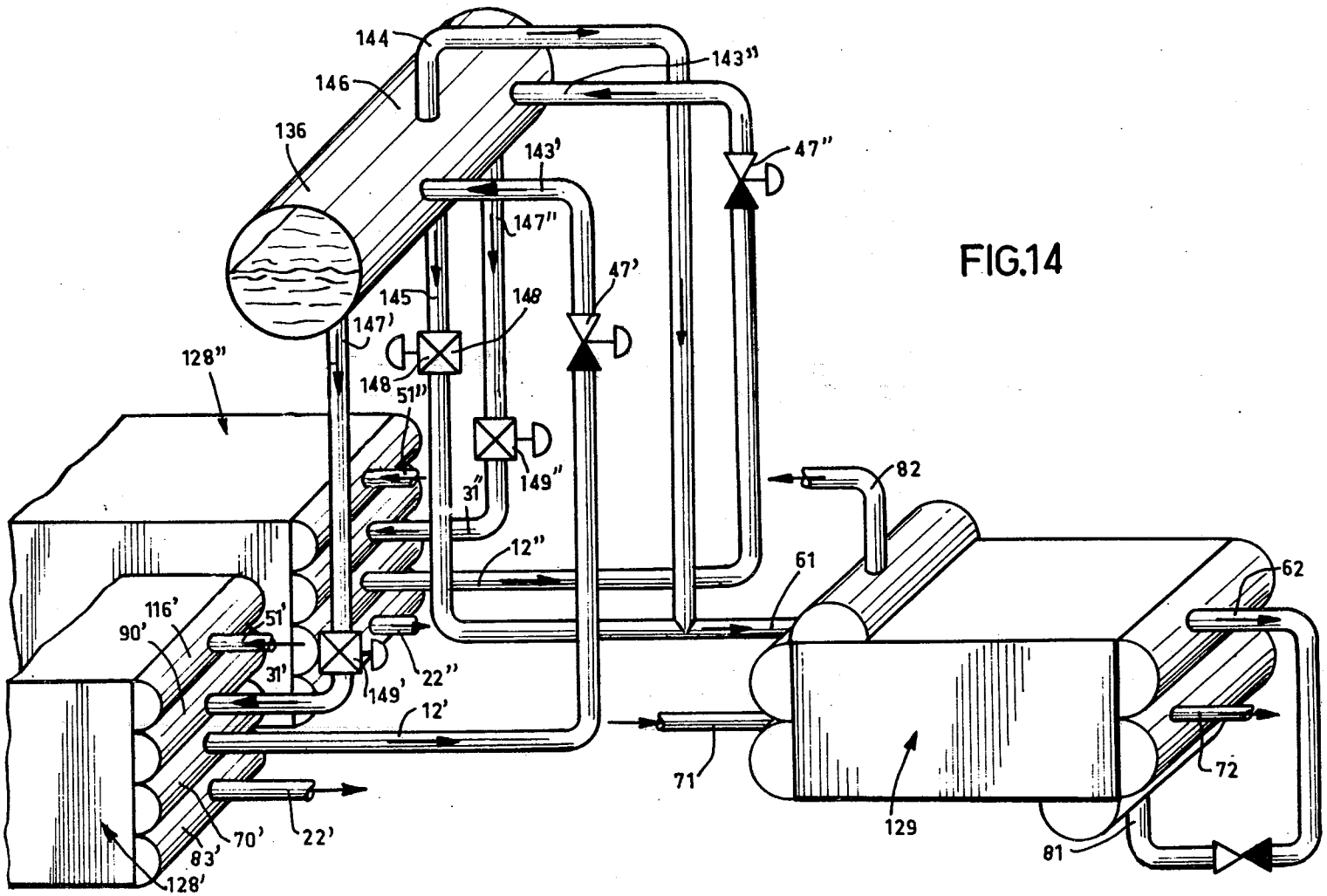
FIG. 14 is a schematic perspective view of part of the thermal exchange assembly as shown in FIGS. 1, 11 and 13 in combination.

The embodiment of the present invention which is shown in FIGS. 13 and 14 differs from that which has been described with reference to FIGS. 11 and 12 principally in the following features:

the means 136 for extracting the cooled refrigerant mixture (first fluid) from the various initial members 128, 128', 128'' consists of a separator 146 for separating the vapour and liquid phases of the refrigerant mixture at the aforesaid evaporation pressure. This separator 146, which is situated at a higher level than the initial members 128, 128', 128'' and than the final thermal exchange member 129, has, firstly, a di-phase inlet 143 which communicates, via the first expansion means 47, with the outlets 12 of the various initial members 128, 128', 128'', secondly a liquid outlet 147, which forms the supply means 138 mentioned above, to supply the liquid refrigerant mixture at the evaporation pressure (third fluid) to the various initial members 128, 128', 128'', and thirdly another liquid outlet 145 and a gas outlet 144 which together form the supply means 140 mentioned above, to supply the di-phase refrigerant mixture at the evaporation pressure (sixth fluid) to the final thermal exchange member 129.

throughput regulating valves 148 and 149 are provided at the liquid outlets 145 and 147 to allow the composition of the refrigerant mixture at the evaporation pressure which enters the final thermal exchange member 129 to be varied, a di-phase distribution arrangement (not shown), similar to that described with reference to FIGS. 11 and 12, is associated with the inlets 61 to the various passages of the sixth type in the final thermal exchange member 129.

Figure 15:
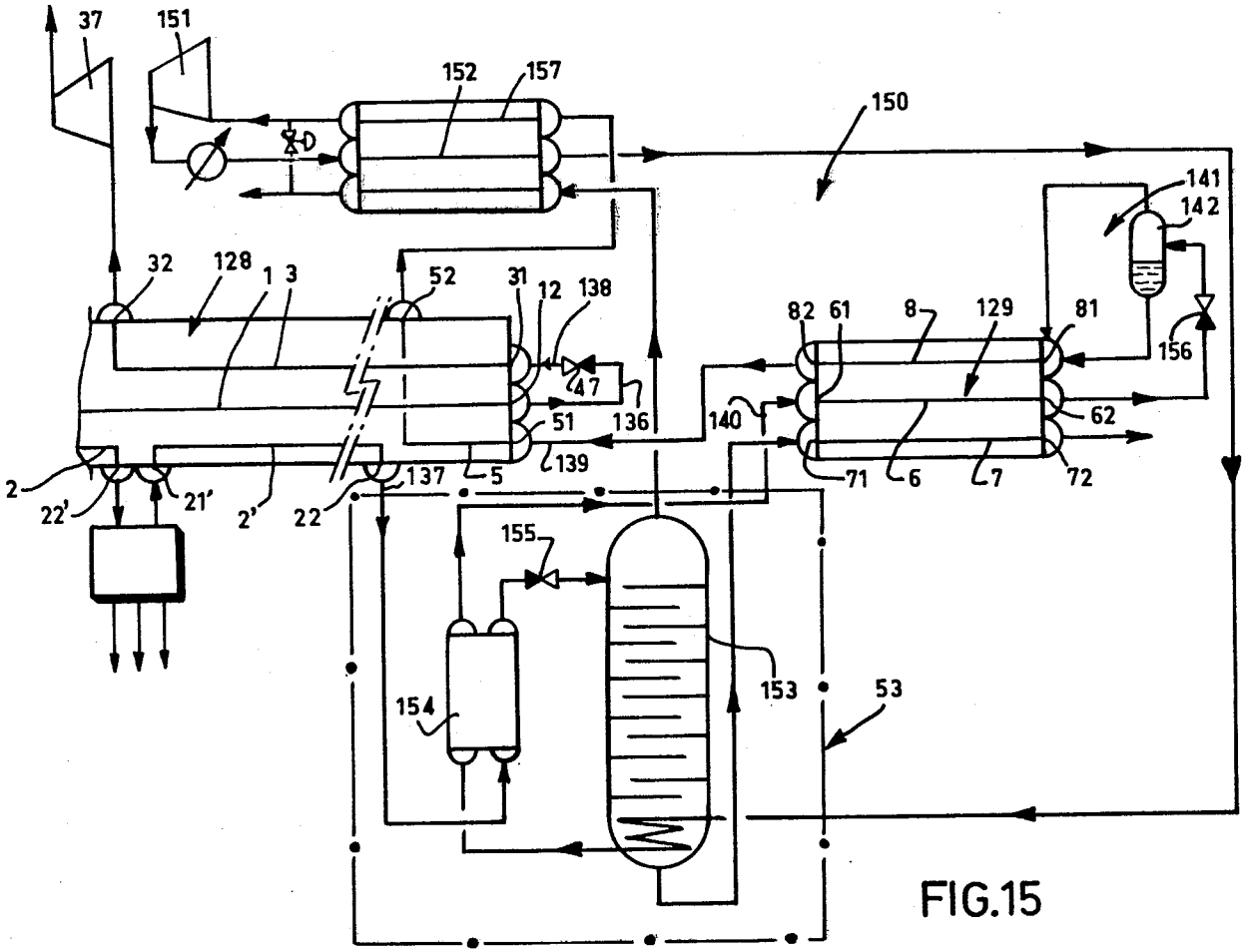
FIG. 15 shows another embodiment of the cooling installation which is shown schematically in FIG. 1, relating only to the part of the latter contained within the dotted line.

Another thermal exchange assembly according to the present invention, which is shown in FIG. 15, differs from those which have been described with reference to FIGS. 11 and 12, and 13 and 14, in the fact that the refrigerant flowing in the final thermal exchange member 129 is a composite refrigerant separate from the refrigerant mixture flowing in the initial members 128, 128', 128''. To this end, the following modifications are made:

at least one passage 5 of the fifth type, which extends in the first dimension of each initial member 128 (128', 128''), from the end at which the inlet 51 for the composite refrigerant to be heated is situated, over only a part of the length of the member 128, and a passage 2 of the second type adjacent to the above-mentioned passage 5 of the fifth type extends in the first dimension of the member 128 (128', 128'') for the whole of the remaining part of the length. A transverse partition (not shown) separates the two passages 2 and 5 respectively of the second and fifth types.

the extraction means 136 described above, which enables the refrigerant mixture at the upper pressure to be extracted from the various initial members 128, 128', 128'' communicates via the first expansion means 47 with the abovementioned supply means 138 which allow refrigerant mixture at the evaporation pressure to be supplied to the various initial members 128, 128' and 128''.

a third cooling cycle 150 is associated thermally in cascade with the second cooling cycle 14, and in it, cyclically and successively:

a composite refrigerant (comprising for example 65% methane and 35% nitrogen), which overall is more volatile than the refrigerant mixture in the second cooling cycle 14, is compressed (151).

the compressed composite refrigerant is cooled (152) by counter-current heat exchange with the evaporated composite refrigerant in course of heating, and with a gas fraction coming from the nitrogen removal unit 53, which is likewise in course of heating.

the compressed and cooled composite refrigerant is condensed, first within a column 153 for removing the nitrogen from liquified natural gas by exchange with the liquified natural gas in course of evaporation, then by co-current heat exchange 154 with the liquified natural gas in course of heating, before its expansion (155) and its entry into the column 153.

the condensed composite refrigerant is sub-cooled in the passages 6 in the final thermal exchange member 129 by counter-current heat exchange with itself.

the sub-cooled composite refrigerant is expanded (156), the expanded composite refrigerant is evaporated by counter-current heat exchange firstly in the passages 8 of the final member 129 with the composite refrigerant in the third cycle which is in course of sub-cooling, and then, in the passage 5 of the various initial members 128, 128' and 128'' with the refrigerant mixture in the second cycle with is in course of sub-cooling.

the evaporated composite refrigerant is heated (157) by heat exchange with itself.

and the evaporated composite refrigerant so heated is re-compressed (151), consequently, after (in the direction of flow of the refrigerant mixture and the natural gas) the first cooling cycle 13, and in the various initial thermal exchange members 128, 128' and 128'' an initial part of the cooling of the refrigerant mixture and the natural gas is performed by counter-current heat exchange with at least a portion, if not the whole, of the refrigerant mixture in course of evaporation at the evaporation pressure, and a final part of the cooling of the refrigerant mixture only is performed by counter-current heat exchange with the composite refrigerant in course of evaporation in the passage 5.

Figure 16:
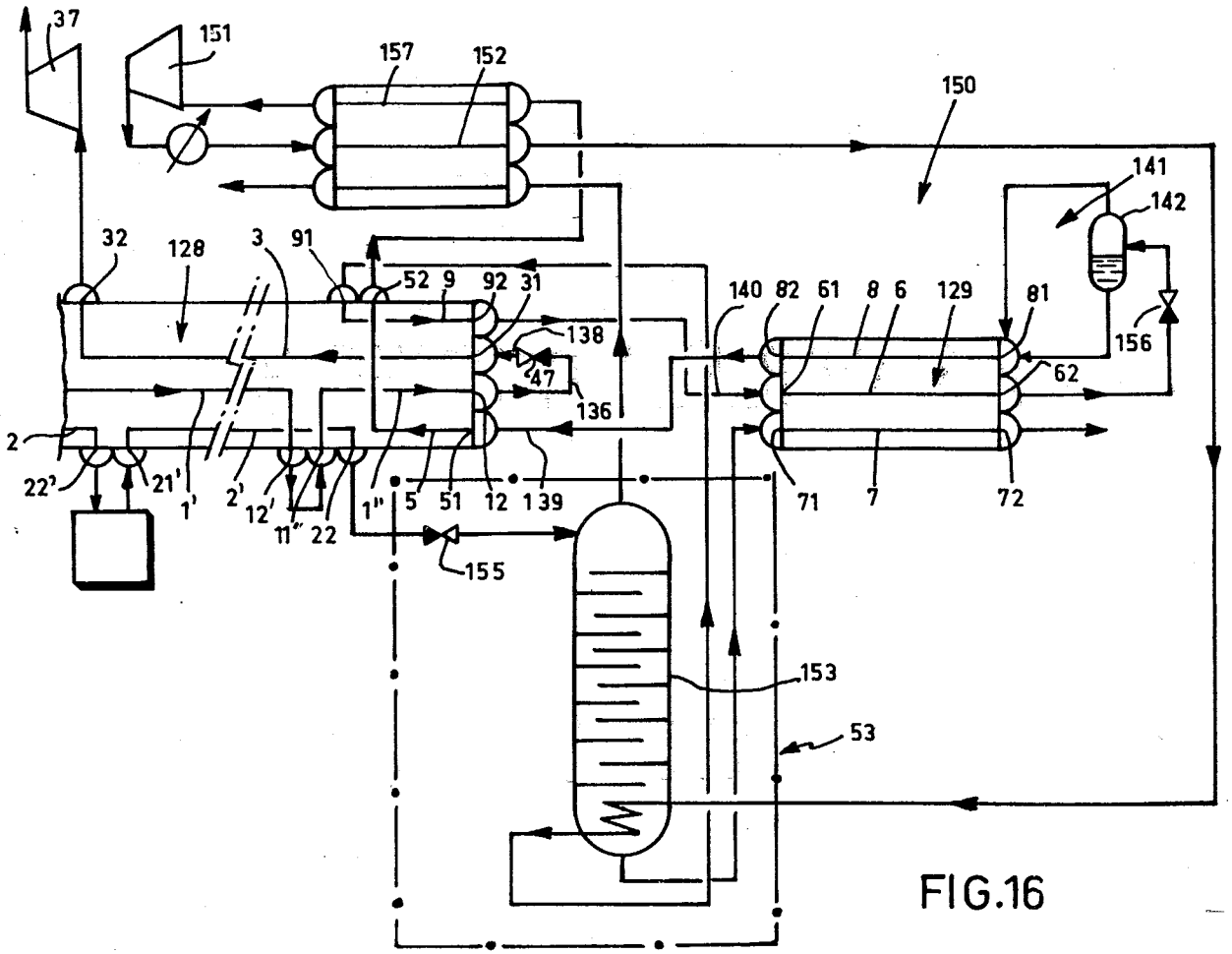
FIG. 16 shows another embodiment of the cooling installation shown schematically in FIG. 1, relating only to the part of the latter which is contained within the dotted line.

The thermal exchange assembly shown in FIG. 16 differs from that shown in FIG. 15 chiefly in the following respects:

each initial thermal exchange member 128 (128', 128'') includes at least one passage 9 of a ninth type belonging to a ninth circuit intended for the flow of the composite refrigerant to be cooled (the ninth fluid) in co-current with the refrigerant mixture to be cooled. The sealing means (not shown) allotted to each passage 9 of the ninth type leave open, at the two ends of the latter, respectively an inlet 91 and an outlet 92 for the composite refrigerant which is continuing its condensation. Each passage 9 of the ninth type, which is in thermal exchange relation simultaneously with two passages 3 and 5 respectively of the third and fifth types, extends in the first dimension of the members 128, 128' and 128'', from the end at which the outlet 92 for the composite refrigerant is situated, over only a section or part of the length of the initial members 128, 128' and 128''.

the various passages 1 of the first type in each initial thermal exchange member 128 (128' 128'') comprise:

a plurality of initial passages 1' of the first type which extend in the first dimension of each member 128, from the end at which the inlet 11 for the refrigerant mixture to be cooled is situated, for a part of the length of the said initial member lying between the above-mentioned section and the passages 4 reserved for the auxiliary refrigerant, another plurality of final passages 1'' of the first type, which are fewer in number than the plurality of initial passages 1' of the first type and which extend in the first dimension of each initial member 128 from the end where the outlet 12 for the cooled refrigerant mixture is situated, over the aforesaid section of the length of each initial member. The various outlets 12' of the various initial passages 1' of the first type communicate, on the outside of each initial thermal exchange member, with the various inlets 11' of the various final passages 1'' of the first type.

the supply means 140 described above which enable composite refrigerant to be supplied to the final thermal exchange member 129 communicate directly with the outlets 92 of the various passages 9 of the ninth type belonging to the various initial thermal exchange members 128.

Figure 18:
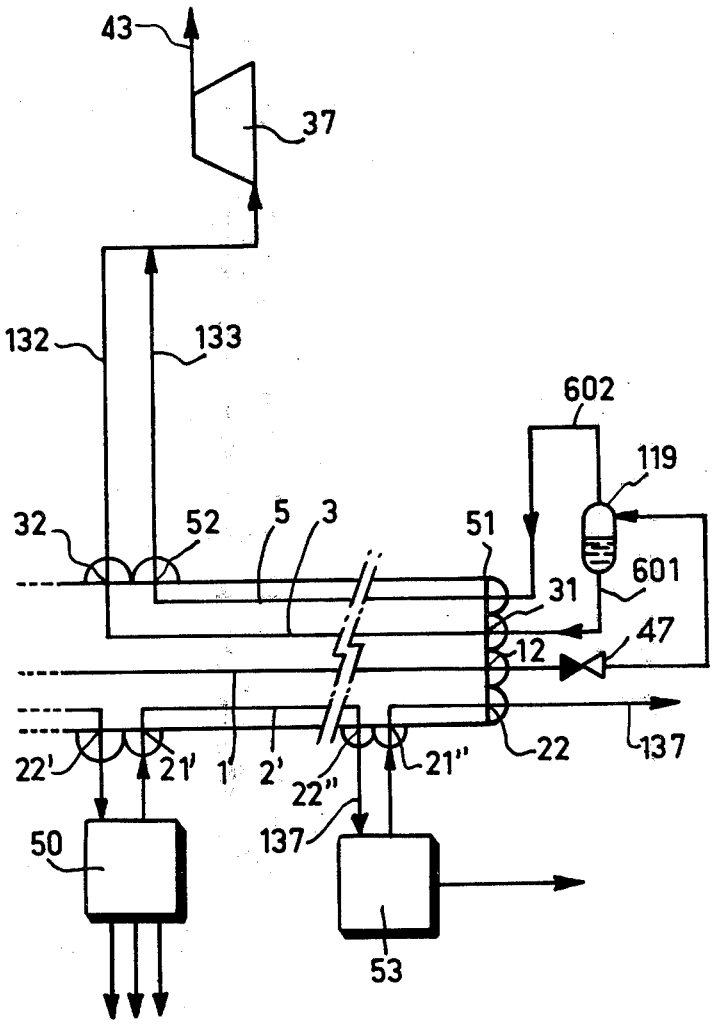
FIG. 18 shows another embodiment of the cooling installation shown schematically in FIG. 1, relating only to the part of the latter contained within the dotted line.

The thermal exchange assembly shown in FIG. 18 makes it possible to dispense entirely with the need for di-phase distribution of the refrigerant mixture before it is heated by counter-current heat exchange with the refrigerant mixture and gas to be cooled, and does so at the cost of a slight reduction in the thermodynamic effectiveness of the cooling cycle employed. To this end, the assembly in FIG. 18 differs from that shown in FIG. 1 in the following respects:

the means 48 for expansion to the low pressure is dispensed with.

the means 119 for the di-phase separation of the refrigerant mixture communicate at its inlet with the outlet of the means 47 for expansion to the evaporation pressure. The inlets 31 of the various passages 3 of the third type in the thermal exchange member 58 communicate with the liquid outlet 601 of the separator 119, which outlet is reserved for the liquid phase of the expanded refrigerant mixture. The inlets 51 of the various passages 5 of the fifth type communicate with the gas outlet 602 of the separator 119, which outlet is reserved for the vapour phase of the expanded refrigerant mixture. The separator 119, which is situated upstream of the expansion valve 47, has a pressure head above the thermal exchange member 58.

on the one hand the outlets 32 of the various passages of the third type, and on the other hand the outlets 52 of the various passages 5 of the fifth type communicate together with the induction side of the compressor 37.

The method of cooling which is employed in the case of FIG. 18 differs from that employed in the case of FIG. 1 in the following respects:

the entire flow of the refrigerant mixture at the low pressure is dispensed with.

only the expanded portion of the refrigerant mixture at the evaporation pressure (but not at the low pressure), that is to say the whole of the said mixture, is separated in the separator 119 into a liquid phase and a vapour phase.

the liquid and vapour phases of the refrigerant mixture which are flowing in co-current with one another are heated separately, in the passages 3 of the third type and the passages of the fifth type, by counter-current heat exchange with both the refrigerant mixture and the gas to be cooled which are continuing with their respective coolings.

the heated vapour phases coming from the passages 3 and 5 are combined and compressed together to the high pressure in the compressor 37.

In view of the small relative throughput of the vapour phase coming from the di-phase separation means 119, the exchanger member may be further simplified by doing away with the passage 5 of the fifth type and connecting the gas outlet 602 directly to the input of the compressor 37 as indicated in broken lines in FIG. 18.

Figure 19:
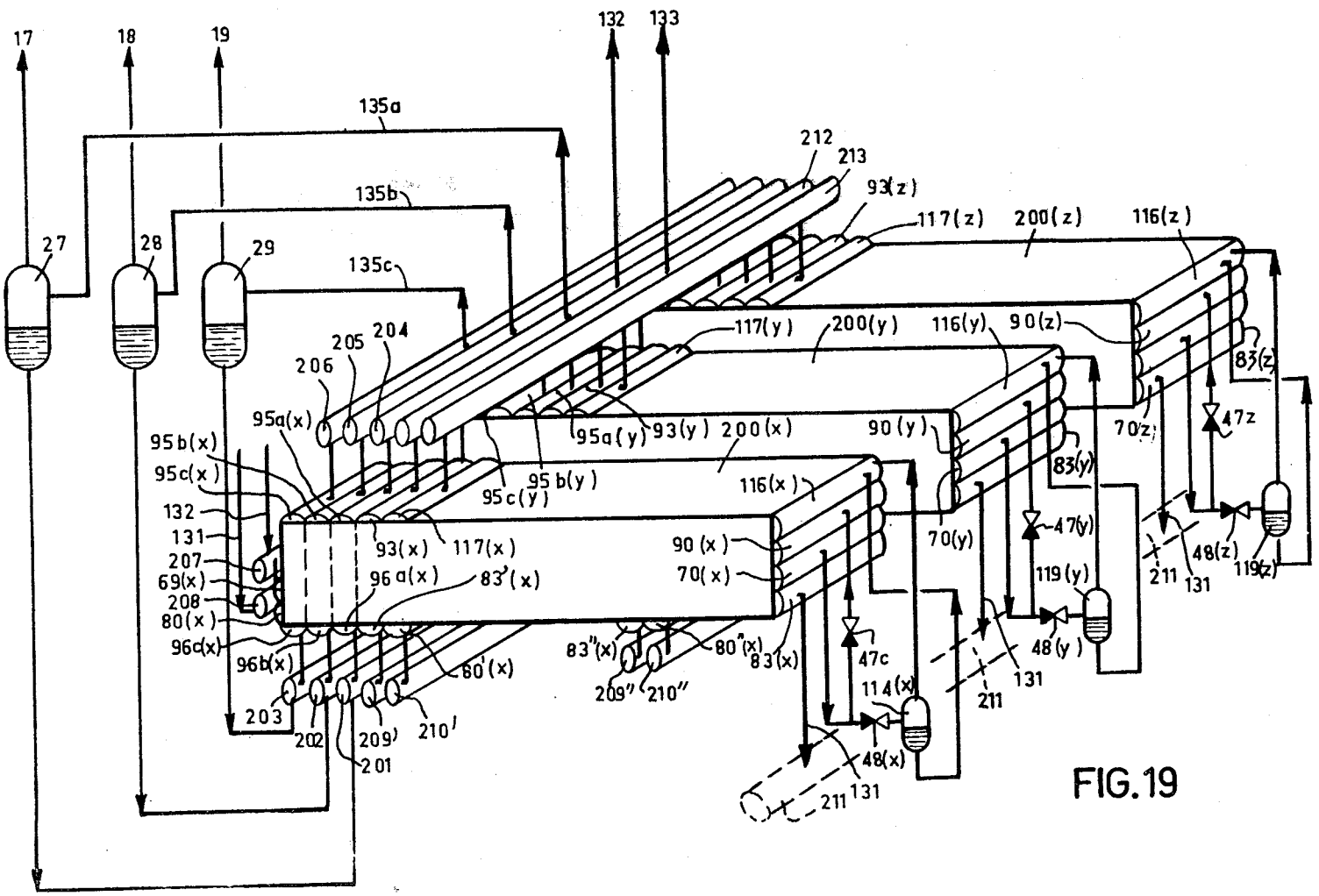
FIG. 19 is a perspective view of another modified embodiment.

Referring to FIG. 19, a thermal exchange assembly comprises three identical thermal exchange members 200(*x*), 200(*y*), 200(*z*) which operate in parallel. Each member is of the type described with reference to FIGS. 1 to 10 and the same reference numberals are used below (even though it has not been possible to include them all in the drawings), the reference numberals being given the index (x), (y) or (z) depending on whether it is member 200(*x*), 200(*y*), 200(*z*) which is involved, while no index is allotted when the constructional components involved are common to the three members 200(*x*), 200(*y*) and 200(*z*).

It will be seen that:

the supply and extraction of the fourth fluid (auxiliary refrigerant) may take place from three supply collectors 201, 202 and 203 common to the three members 200(*x*), 200(*y*), and 200(*z*), which are connected on the upstream side to the "liquid" part of the common separators and on the downstream side to the various inlet headers 96*a*(*x*), 96*b*(*x*), 96*c*(*x*), 96*a*(*y*), 96*b*(*y*) . . . 96*c*(*z*) and from three common extraction collectors 204, 205 and 206 which are connected on the upstream side to the various outlet headers 96*a*(*x*), 95*b*(*x*), 95*a*(*y*), 95*b*(*y*) . . . 95*c*(*z*) and on the downstream side of ducts 135*a*, 135*b*, 135*c*. There is no danger of upsetting the distribution because, since the flow of the fourth fluid takes place with a considerable thermal siphon effect, the quantity of refrigerant fluid fed into each passage is very much greater than the quantity effectively evaporated and the unevaporated liquid extracted by the collectors 204, 205, 206 is re-used after passage through the separators 27, 28 and 29.

The outlets and inlets 69(*x*), 69(*y*), 69(*z*) of the passages for the first fluid (refrigerant mixture) and the inlets 80(*x*), 80(*y*), 80(*z*) to the passages for the second fluid (gas to be refrigerated) are respectively connected to a collector 207 for supplying the first fluid and a collector 208 for supplying the second fluid. The supply collector 207 is connected to the duct 130 for supplying refrigerant mixture and the supply collector 208 is connected to the duct 131 for supplying gas to be cooled. Likewise, the intermediate outlet headers 83'(*x*), 83'(*y*), 83'(*z*), 83''(*x*), 83''(*y*), 83''(*z*) and the intermediate inlet headers 80'(*x*), 80'(*y*), 80'(*z*), 80''(*x*), 80''(*y*), 80''(*z*) are connected to intermediate outlet collectors 209' and 209'' and to intermediate inlet collectors 210' and 210'', in the same way as the final outlet headers 83(*x*), 83(*y*), 83(*z*) of the second passages (gas to be refrigerated) are connected to a collector 211.

Similarly, the outlet headers 93(*x*), 93(*y*), 93(*z*) for the third fluid (refrigerant mixture heated at the evaporation pressure) and the outlet headers 117(*x*), 117(*y*), 117(*z*) for the fifth fluid are connected to extraction collectors 212 and 213, which are themselves connected to ducts 132 and 133.

The outlet headers 70(*x*), 70(*y*), 70(*z*) on the other hand are connected individually on the one hand via the respective expansion means 47(*x*), 47(*y*), 47(*z*) to the inlet headers for the passages 90(*x*), 90(*y*), 90(*z*) of the third type, and on the other hand via the respective expansion means 48(*x*), 48(*y*), 48(*z*) and the respective separators 119(*x*), 119(*y*), 119(*z*) to the inlet headers 116(*x*), 116(*y*) 116(*z*) for the passages of the fifth type.

By virtue of the arrangement described, the refrigerant mixture which has been cooled and condensed in an exchange member is, by reason of the individual expansion and the individual return to the same exchange member, entirely re-used in one and the same exchange member. There is thus an assurance of complete equilibriumin in each thermal exchange member between the refrigerant mixture in course of cooling and this same refrigerant mixture in course of heating, exactly as if each exchanger were operating independently. The adjustment of each individual thermal exchange member is performed for example by adjusting all the expansion valves 47(*x*), 47(*y*), 47(*z*) to be open by the same amount, while the expansion valves 48(*x*), 48(*y*), 48(*z*) are adjusted to give the desired temperature at the cold end of each thermal exchange member.

As indicated above, the present invention is applicable in particular to liquefying large or small amounts of natural gas or mixtures of gases, particularly mixtures of natural gas.

I claim:

1. In a thermal exchange assembly including at least one thermal exchange member of the plate heat-exchanger kind comprising a plurality of metal plates of substantially identical outline which extend in a first dimension, or length, and a second dimension, or width, and which are spaced apart from and arranged parallel to one another in a third dimension, or thickness, and sealing means which, in conjuction with the plates, define a plurality of flattened passages, forming:

at least one passage of a first type, belonging to a first circuit intended for the flow, for the whole length of the said member, of a first fluid the sealing means allotted to a passage of said first type leaving open, at the two ends of the latter, an inlet and an outlet respectively for said first fluid, and/or at least one passage of a second type, belonging to a second circuit intended for the flow, in the lengthwise direction of the said member, of a second fluid in co-current with said first fluid, the sealing means allotted to a passage of said second type leaving open, at the two ends of the latter, an inlet and an outlet respectively for said second fluid, at least one passage of a third type in thermal exchange relation with at least one of the two passages of said first and said second types and belonging to a third circuit intended for the flow, for a part of the length of the said member, of a third fluid in counter-current with said first and said second fluids, the sealing means allotted to a passage of said third type leaving open an inlet and an outlet for said third fluid, the invention which comprises the combination of the following features:

(a) said thermal exchange member includes at least one passage of a fourth type in thermal exchange relation with at least one of the two passages of said first and second types and belonging to a fourth circuit instead to receive a fourth fluid, the sealing means allotted to a said passage of the fourth type leaving open, at the two ends of the latter, a first opening and a second opening respectively reserved for the said fourth fluid, (b) at least one passage of said fourth type adjacent a passage of said third type extends for another part of the length of the said member; and at least one transverse partition which extends for the width of the said member separates the two passages of said third and said fourth types from one another.

2. An assembly according to claim 1, wherein said inlets to said passages of the third type are connected via an expansion means to said outlets of said passages of said first type.

3. An assembly according to claim 1, which includes at least two thermal exchange members which are distinguished from one another as regards said first and said second types in that one has only a passage of said first type and the other has only a passage of said second type.

4. An assembly according to claim 1, which includes at least one thermal exchange member which has on the one hand both at least one passage of said first type and at least one passage of said second type, and on the other hand two passages of said third and said fourth types respectively, each in thermal exchange relation with both of said two passages respectively of said first and said second types.

5. An assembly according to claim 1, wherein said passage of said fourth type in the thermal exchange member extends for the width of the said member.

6. An assembly according to claim 1, wherein a plurality of passages of said fourth type is provided one of which is termed supplementary and another additional, the said plurality of passages extending over successive parts of the length of the member.

7. An assembly according to claim 1, wherein said thermal exchange member includes at least one passage of a fifth type in thermal exchange relation with at least one of said two passages of said first and second types and belonging to a fifth circuit intended for the flow, for a part of the length of the said member, of a fifth fluid in co-current with the refrigerant mixture to be heated, the sealing means allotted to a passage of the fifth type leaving open an inlet and an outlet for the fifth fluid.

8. An assembly according to claim 7, wherein a passage of said fourth type adjacent to a passage of said fifth type is arranged over another part of the length of the said member, and at least one transverse partition which extends for the width of the said member separates said two passages of the fourth and fifth types.

9. An assembly according to claim 7, wherein the inlets to said passages of said fifth type are connected via an expansion means to the outlets of said passages of said first type.

10. An assembly according to claim 8, wherein a di-phase distribution arrangement, which enables a gaseous phase and a liquid phase to be uniformly distributed between the various passages of said fifth type in said thermal exchange member, is associated with said inlets to the said passages of the fifth type.

11. An assembly according to claim 1, which further includes a plurality of thermal exchange members connected in parallel, said inlets and outlets of said passages of said second type, said inlets to said passages of said first type, and said outlets of the passages of said third type in the various members being connected respectively to a supply collector and an extraction collector for said second fluid, to a supply collector for said first fluid, and to an extraction collector for said third fluid, said inlets and outlets of the passages of said fourth type being in a similar way respectively connected to a supply collector and an extraction collector for a fourth fluid.

12. An assembly according to claim 11, wherein said inlets to said passages of the third, and where applicable the fifth, types in each member are connected by expansion means to the outlets of the passages of said first type only in the said member.

13. An assembly according to claim 1, of the kind comprising a plurality of initial thermal exchange members and a smaller number of final thermal exchange members each having at least one passage of a sixth type for a sixth fluid, at least one passage of a seventh type for a seventh fluid and at least one passage of an eighth type in thermal exchange relation with the said passages of the sixth and seventh types for an eighth fluid, wherein the inlets to the passages of said sixth type are connected to the collector for extracting said first fluid from the said initial members, the inlets to the passages of the seventh type being connected to the extraction collector for said second fluid, the inlets to the passages of the eighth type being connected via expansion means associated with separating means to the outlets of said passages of said sixth type, while the outlets of the said passages of the eighth type are connected to the inlet collector for the passages of said fifth type in the said initial members.

14. An assembly according to claim 13, wherein said collector for the extraction of the first fluid from the said initial thermal exchange members is associated with a separator for separating the gaseous and liquid phases of the said first fluid, the said separator, which is situated at a higher level than said at least one final thermal exchange member, having on the one hand a liquid outlet which forms the said means for supplying said third fluid to the various initial members, and on the other hand another liquid outlet and a gas outlet which together form the said means for supplying said sixth fluid to said final thermal exchange member.

15. An assembly according to claim 6, wherein at least two other consecutive plates in said thermal exchange member define, between them, on the one hand a passage of said fifth type which extend in the first dimension from the end at which said fifth fluid enters for only a part of the length of the said member, and on the other hand a passage of said second type adjacent to the said passage of the fifth type which extends in the first dimension for another part of the length of the said member, and at least one other partition, which extends for the width of the said member between the above-mentioned two other consecutive plates, separates from one another the two passages respectively of the second and fifth types which are defined by the said other plates.

16. An assembly according to claim 15, wherein on the one hand, said thermal exchange member includes at least one passage of a ninth type belonging to a ninth circuit intended for the flow of a ninth fluid in co-current with the refrigerant mixture to be cooled, the sealing means allotted to a passage of the ninth type leaving open, at the two ends of the latter, respectively an inlet and an outlet for the ninth fluid, said passage of the ninth type, which is in thermal exchange relation with both of the two passages respectively of said third and fifth types, extending in the first dimension from the end at which said ninth fluid leaves, for only a section of the length of the said member, and on the other hand the various passages of said first type in said thermal exchange member comprise:

a plurality of initial passages of said first type which extend in the first dimension, from the end where said first fluid enters, for the part of the length of the said member other than the section mentioned, another plurality of final passages of said first type fewer in number than the plurality of initial passages of said first type which extend in the first dimension from the end at which said first fluid leaves, for the abovementioned section of the length of the said member, the various outlets of the various initial passages of said first type communicating, on the outside of the thermal exchange member, with the various inlets to the various final passages of said first type.

17. An assembly according to claim 14, including a plurality of said initial thermal exchange members, each of which is in addition characterized in that at least two other consecutive plates in said thermal exchange member define, between them, on the one hand a passage of said fifth type which extend in the first dimension from the end at which said fifth fluid enters for only a part of the length of the said member, and on the other hand a passage of said second type adjacent to the said passage of the fifth type which extends in the first dimension for another part of the length of the said member, and at least one other partition, which extends for the width of the said member between the above-mentioned two other consecutive plates, separates from one another the two passages respectively of the second and fifth types which are defined by the said other plates, and wherein said means for the extraction of said first fluid from the various initial thermal exchange members communicate with the said means for supplying said third fluid to the said initial members.

18. An assembly according to claim 17, wherein said means for supplying said sixth fluid to said at least one least final thermal exchange member is connected to an outlet collector for said passages of said ninth type belonging to the various initial thermal exchange members.

* * * * *